US010534319B2

(12) United States Patent
Fukuda et al.

(10) Patent No.: US 10,534,319 B2
(45) Date of Patent: Jan. 14, 2020

(54) ESCAPEMENT FOR TIMEPIECE

(71) Applicant: CITIZEN WATCH CO., LTD., Nishitokyo-shi, Tokyo (JP)

(72) Inventors: Tadahiro Fukuda, Tokorozawa (JP); Shinpei Fukaya, Kodaira (JP)

(73) Assignee: CITIZEN WATCH CO., LTD., Tokyo (JP)

( * ) Notice: Subject to any disclaimer, the term of this patent is extended or adjusted under 35 U.S.C. 154(b) by 0 days.

(21) Appl. No.: 15/754,103

(22) PCT Filed: Aug. 2, 2016

(86) PCT No.: PCT/JP2016/072686
§ 371 (c)(1),
(2) Date: Feb. 21, 2018

(87) PCT Pub. No.: WO2017/033688
PCT Pub. Date: Mar. 2, 2017

(65) Prior Publication Data

US 2018/0231936 A1 Aug. 16, 2018

(30) Foreign Application Priority Data

Aug. 25, 2015 (JP) ..... 2015-165649
Nov. 26, 2015 (JP) ..... 2015-230669

(51) Int. Cl.
*G04B 15/14* (2006.01)

(52) U.S. Cl.
CPC ..... *G04B 15/14* (2013.01)

(58) Field of Classification Search
CPC ..... G04B 15/14
(Continued)

(56) References Cited

U.S. PATENT DOCUMENTS 7,708,454 B2 * 5/2010 Marmy ..... G04B 15/14 368/127
8,308,346 B2 * 11/2012 Conus ..... G04B 15/08 368/124

(Continued)

FOREIGN PATENT DOCUMENTS

CH 706224 A2 9/2013
CN 1270331 A 10/2000

(Continued)

OTHER PUBLICATIONS

Extended European Search Report; Application No. 16839035.9; dated Feb. 15, 2019; 6 pages.

(Continued)

*Primary Examiner* — Edwin A. Leon
*Assistant Examiner* — Jason M Collins
(74) *Attorney, Agent, or Firm* — Knobbe, Martens, Olson & Bear LLP

(57) ABSTRACT

An escapement for a timepiece includes an escape wheel that rotates about a shaft center and a pallet that oscillates. The escape wheel includes fifteen teeth. The pallet includes an entry pallet jewel and an exit pallet jewel that switch the rotation and stop of the escape wheel and receive torque from the escape wheel by contacting the teeth. The escape wheel and a balance (an impulse pin) apply and receive torque only via the pallet. The pallet includes a third pallet jewel (a torque applying and receiving member) that receives torque from a convex portion of the escape wheel in addition to the entry pallet jewel and the exit pallet jewel.

12 Claims, 23 Drawing Sheets

(58) Field of Classification Search
USPC ..... 368/124–133
See application file for complete search history.

(56) References Cited

U.S. PATENT DOCUMENTS

| | | | | |
|---|---|---|---|---|
| 8,439,557 | B2 * | 5/2013 | Vaucher ..... | G04B 13/021 368/131 |
| 2007/0201317 | A1 | 8/2007 | Houlon | |
| 2011/0310709 | A1 | 12/2011 | Vaucher et al. | |
| 2015/0029827 | A1 | 1/2015 | Koda et al. | |

FOREIGN PATENT DOCUMENTS

| | | | |
|---|---|---|---|
| CN | 101091141 | A | 12/2007 |
| CN | 102368148 | A | 3/2012 |
| CN | 103309224 | A | 9/2013 |
| CN | 104345627 | A | 2/2015 |
| EP | 1045297 | A1 | 10/2000 |
| EP | 2400351 | A1 | 12/2011 |
| FR | 206 876 | A | 7/1890 |
| JP | 2000-304874 | A | 11/2000 |
| JP | 2012-008125 | A | 1/2012 |
| JP | 2013-185982 | A | 9/2013 |
| JP | 2013-186078 | A | 9/2013 |
| KR | 10-2011-0139110 | A | 12/2011 |

OTHER PUBLICATIONS

Chinese Office Action dated Jul. 1, 2019; CN Application No. 201680047287.0; 6 pages (translation to be provided upon request).

* cited by examiner

ESCAPEMENT FOR TIMEPIECE

CROSS-REFERENCE TO RELATED APPLICATIONS

The present application is based on and claims priority from Japanese Patent Application No. 2015-165649 filed on Aug. 25, 2015 and Japanese Patent Application No. 2015-230669 filed on Nov. 26, 2015, the disclosures of which are hereby incorporated by reference in its entirety.

TECHNICAL FIELD

This invention relates to an escapement for a timepiece.

BACKGROUND ART

As one type of an escapement for a mechanical timepiece, a so-called Swiss lever type escapement is known. The escapement includes an escape wheel, an anchor or pallet, and an impulse pin. The impulse pin is disposed on a roller which integrally oscillates with a balance. Such an escapement has high safety and excellent restartability (See, Patent Literature 1: JP 2013-185982 A1, for example).

SUMMARY

However, the Swiss lever type escapement has a problem that the transmission efficiency of energy (torque) from the escape wheel to the pallet is low.

The present invention is made in view of the above problems. An object of the present invention is to provide an escapement for a timepiece which improves the transmission efficiency of energy from the escape wheel to the pallet.

A present invention is an escapement for a timepiece including an escape wheel that is configured to rotate about a shaft center and includes a plurality of teeth and a torque applying member that applies torque, and a pallet that oscillates and includes an entry pallet jewel and an exit pallet jewel. The entry pallet jewel switches a rotation of the escape wheel and a stop of the escape wheel and receives torque from the escape wheel by contacting a tooth of the teeth. The exit pallet jewel at least switches the rotation of the escape wheel and the stop of the escape wheel. The escape wheel and a balance apply and receive torque only via the pallet. In addition to the entry pallet jewel and the exit pallet jewel, the pallet includes a torque receiving member that receives torque from the torque applying member by contacting the torque applying member.

A first invention is an escapement for a timepiece including an escape wheel that is configured to rotate about a shaft center and includes a plurality of teeth and a torque applying member that applies torque, and a pallet that oscillates and includes an entry pallet jewel and an exit pallet jewel, for example. The entry pallet jewel and the exit pallet jewel switch a rotation of the escape wheel and a stop of the escape wheel, and receive torque from the escape wheel by contacting a tooth of the teeth. The escape wheel and a balance apply and receive torque only via the pallet. In addition to the entry pallet jewel and the exit pallet jewel, the pallet includes a torque receiving member that receives torque from the escape wheel.

A second invention is an escapement for a timepiece including an escape wheel that is configured to rotate about a shaft center, and includes a plurality of teeth and a torque applying member that applies torque, and a pallet that oscillates and includes an entry pallet jewel and an exit pallet jewel, for example. The entry pallet jewel switches a rotation of the escape wheel and a stop of the escape wheel. The exit pallet jewel switches a rotation of the escape wheel and a stop of the escape wheel, and receives torque from the escape wheel by contacting a tooth of the teeth. The escape wheel and a balance apply and receive torque only via the pallet. The pallet includes a torque receiving member at a portion having a distance from a center of the oscillation of the pallet longer than a distance from the center of the oscillation of the pallet to the entry pallet jewel. The torque receiving member receives torque by contacting the torque applying member during a period from when the entry pallet jewel disengages from the tooth until the exit pallet jewel contacts the tooth.

DETAILED DESCRIPTION

First Embodiment

Hereinafter, the first embodiment (Embodiment I) of an escapement for a timepiece according to the present invention is described with reference to drawings.

(Configuration of Escapement)

Figure 1:
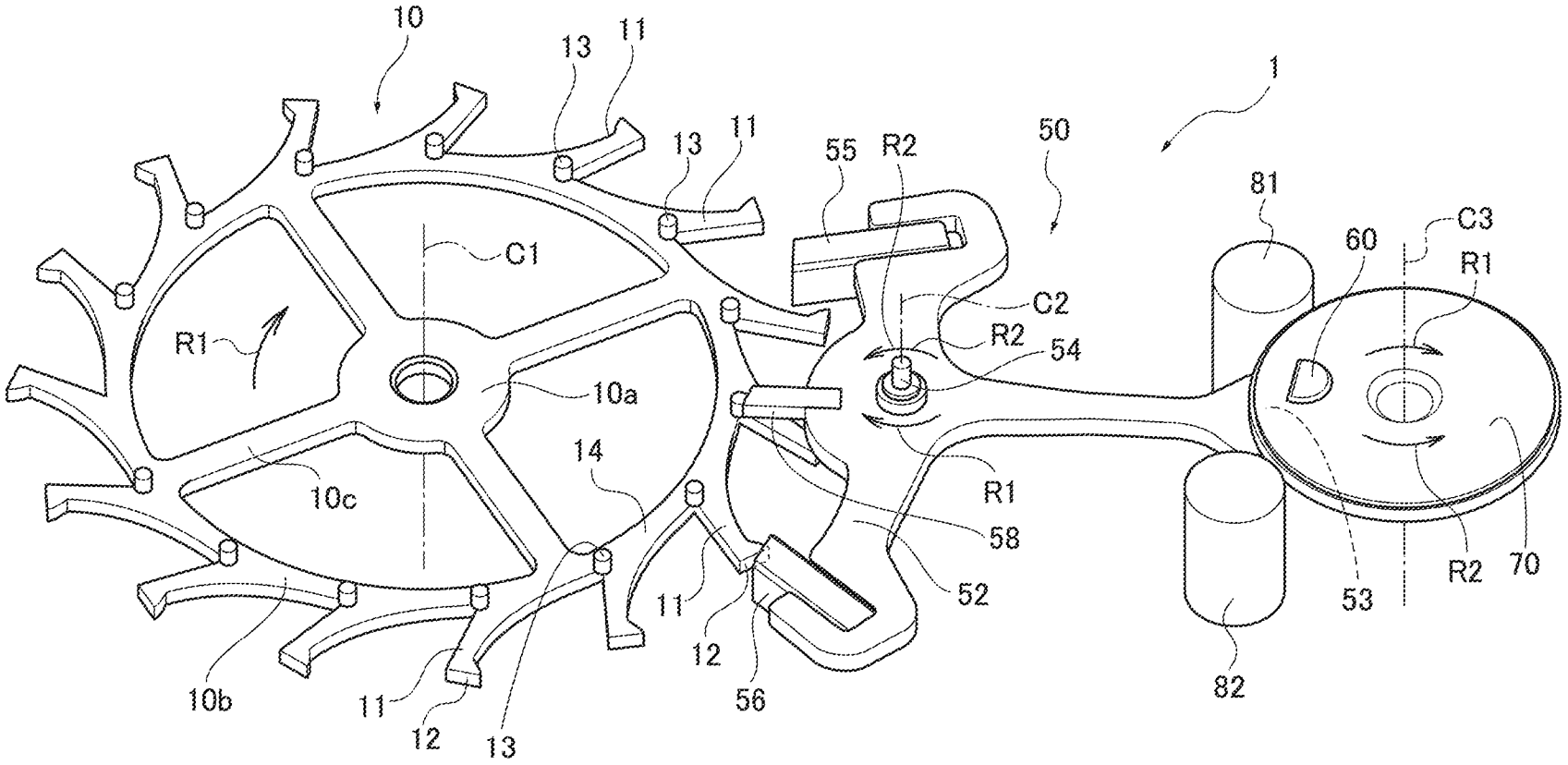
FIG. 1 is a perspective view illustrating an escapement for a portable timepiece (a wristwatch, for example) according to an embodiment (a first embodiment) of the present invention.
Figure 2A:
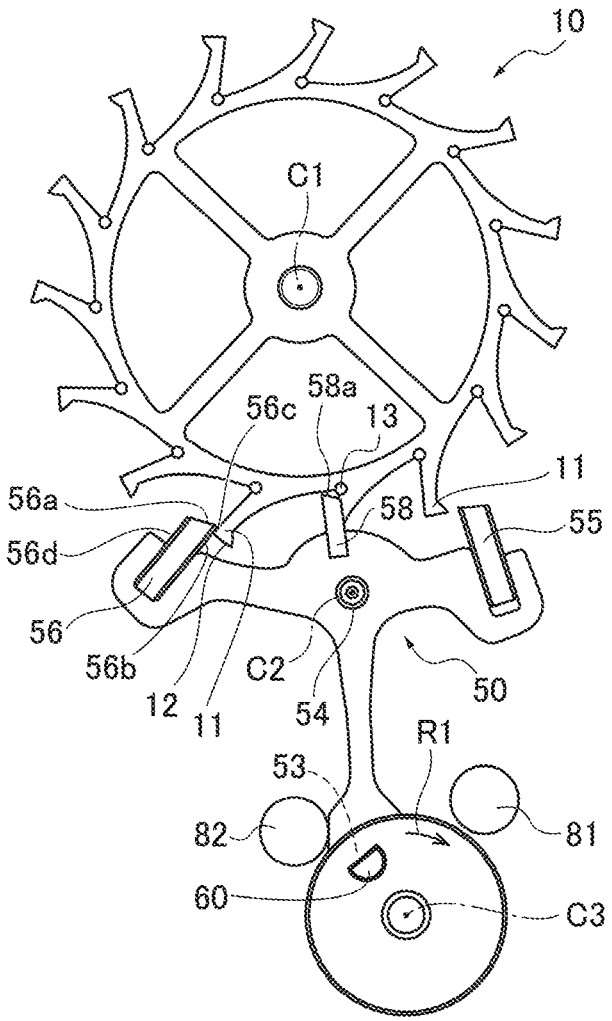
FIG. 2A is a plan view (first) illustrating the operation of the escapement and a state in which an escape wheel is stopped by an exit pallet jewel.
Figure 2B:
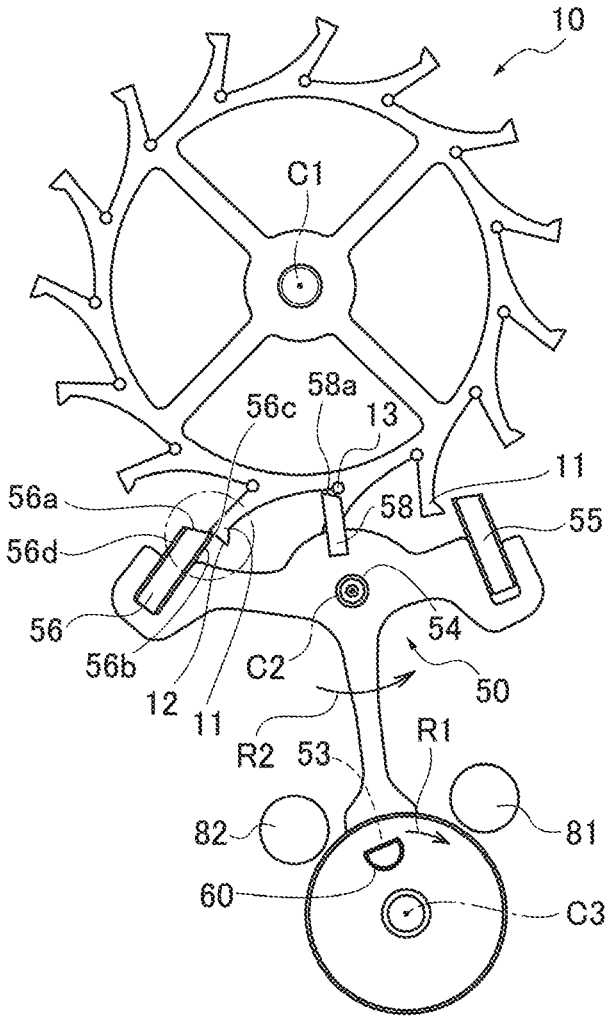
FIG. 2B is a plan view (first) illustrating the operation of the escapement and a state of a first half period of an impact input in which the stop of the escape wheel by the exit pallet jewel is released.
Figure 3A:
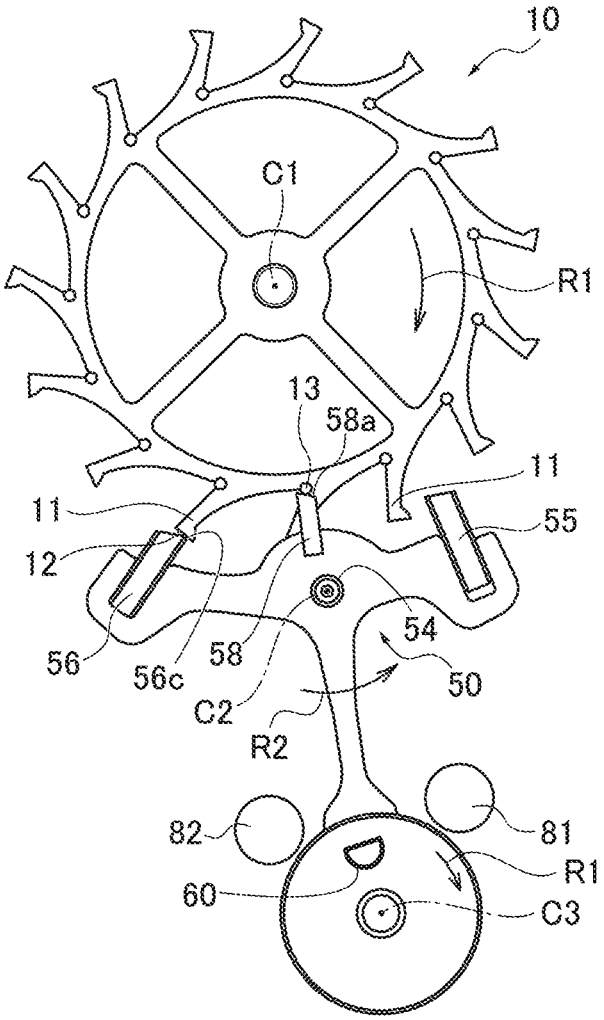
FIG. 3A is a plan view (second) illustrating the operation of the escapement and a state in which the first half period of the impact input is shifting to a second half period.
Figure 3B:
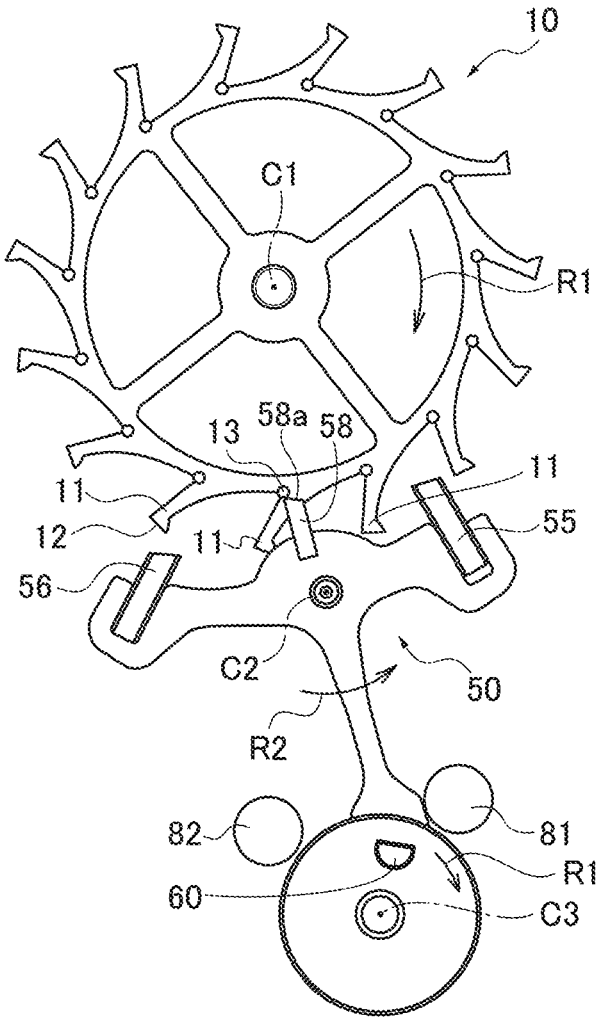
FIG. 3B is a plan view (second) illustrating the operation of the escapement and a state of the second half period of the impact input.
Figure 4:
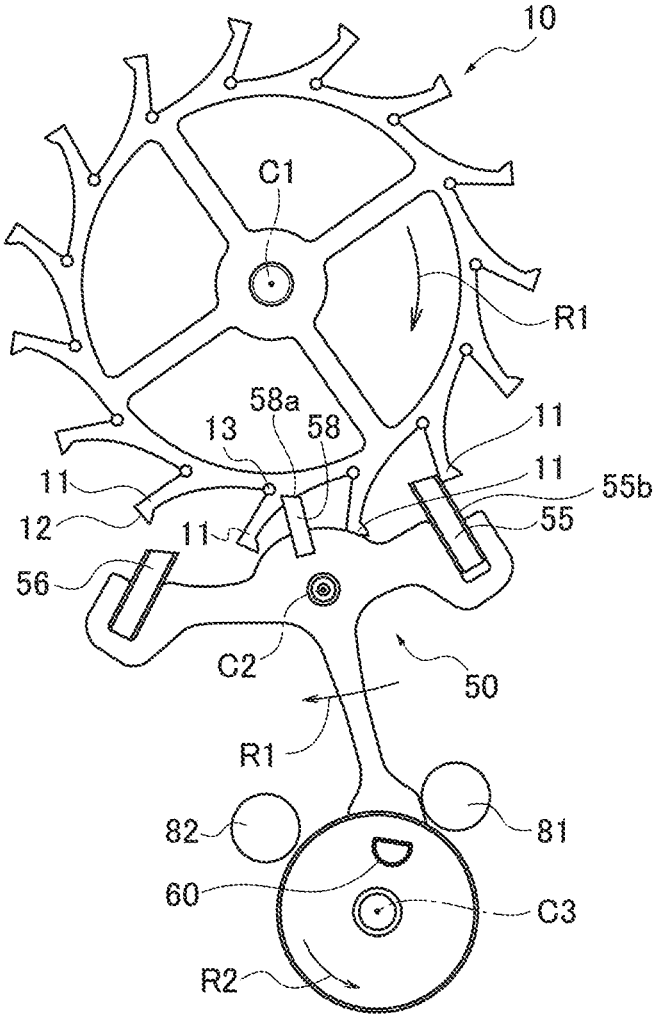
FIG. 4 is a plan view (third) illustrating the operation of the escapement and a state in which the impact input ends and the escape wheel is stopped by an entry pallet jewel.

FIG. 1 is a perspective view illustrating an escapement 1 for a portable timepiece (a wristwatch, for example) according to the first embodiment of the present invention. FIG. 2A is a plan view (first) illustrating the operation of the escapement 1 and a state where an exit pallet jewel 56 stops an escape wheel 10. FIG. 2B is a plan view (first) illustrating the operation of the escapement 1 and a state of a first half period of an impact input in which the stop of the escape wheel 10 by the exit pallet jewel 56 is released. FIG. 3A is a plan view (second) illustrating the operation of the escapement 1 and a state in which the first half period of the impact input is shifting to a second half period. FIG. 3B is a plan view (second) illustrating the operation of the escapement 1 and a state of the second half period of the impact input. FIG. 4 is a plan view (third) illustrating the operation of the escapement 1 and a state in which the impact input ends and the escape wheel 10 is stopped by an entry pallet jewel 55.

As shown in FIG. 1, the escapement 1 is a Swiss lever type escapement including an escape wheel 10, an anchor or pallet 50, and an impulse pin 60. Note that the escape wheel 10 does not apply torque to rotating members other than the pallet 50. In a case of an escapement such as a coaxial escapement in which the escape wheel applies torque to rotating members such as a balance and the like other than the pallet, it is necessary for the escapement to include a larger escape wheel and a larger pallet, and also to have an increased rotation angle per oscillation. As a result, the escapement requires larger torque compared to the escapement 1 to drive the escape wheel and the pallet.

(Impulse Pin)

An impulse pin 60 is provided on a roller 70 of a balance. The roller 70 oscillates with the balance about a shaft center C3. The oscillation reciprocates the impulse pin 60 about the shaft center C3 in the clockwise direction and the counterclockwise direction as shown in the figure.

(Escape Wheel)

The escape wheel 10 rotates about a shaft center C1 in the clockwise direction R1 with drive force (energy, torque) applied via a gear train. The escape wheel 10 includes an inner wheel portion 10*a*, an outer wheel portion 10*b*, and four link portions 10*c*. The inner wheel portion 10*a* is located closer to a center of the escape wheel 10 which corresponds to a side of the shaft center C1. The outer wheel portion 10*b* is located farther away from the center. The four link portions 10*c* radially extend to connect the inner wheel portion 10*a* and the outer wheel portion 10*b*. Further, the escape wheel 10 includes a plurality of teeth 11 outwardly extending from the outer wheel portion 10*b* and circumferentially arranged at equal intervals. Each of the teeth 11 is inclined toward the rotation direction.

The escape wheel 10 shown in FIG. 1 includes fifteen teeth 11. The number of the teeth 11 in the escape wheel 10 is not limited to fifteen as provided in this embodiment, and may be more than or less than fifteen.

As shown in FIGS. 2A, 2B, 3A, 3B and 4, each of the teeth 11 includes a surface 12 facing the radially outside of the escape wheel 10. The surface 12 contacts the entry pallet jewel 55 and the exit pallet jewel 56 respectively, so that the tooth 11 pushes the entry pallet jewel 55 and the exit pallet jewel 56 when the escape wheel 10 rotates, and accordingly, torque is applied from the escape wheel 10 to the pallet 50.

Further, the escape wheel 10 includes convex portions 13 as an example of a torque applying member according to the present invention. Each of the convex portions 13 is disposed on the outer wheel portion 10*b* in the vicinity of the root of each tooth 11. Therefore, each convex portion 13 is provided on a portion of the escape wheel 10 where a radial distance between the portion and the shaft center C1 becomes shorter than a radial distance between the shaft center C1 and the surface 12 of the tooth 11. Note that the convex portion 13 is not limited to one provided on the portion of the escape wheel 10 where the radial distance between the portion and the shaft center C1 becomes shorter than the radial distance between the shaft center C1 and the surface 12 of the tooth 11.

The number of the convex portions 13 is the same as that of the teeth 11. Each of the convex portions 13 protrudes from an end surface 14 of the escape wheel 10, which is perpendicular to the shaft center C1. In this embodiment, each convex portion 13 is formed in a shorter cylindrical shape. However, the shape of the torque applying member of the present invention is not limited to the shorter cylindrical shape.

In addition, the convex portions 13 are not limited to ones formed to protrude from the end surface 14 of the escape wheel 10, but may be formed to radially extend from the escape wheel 10. The convex portions 13 apply torque from the escape wheel 10 to the pallet 50 via a route different from the one with the teeth 11, the entry pallet jewel 55 and the exit pallet jewel 56, which will be described below.

The escape wheel 10 may be made of silicon and may be formed by a Deep RIE (deep reactive ion etching) process, for example.

(Pallet)

The pallet 50 stops the rotation of the escape wheel 10 at a predetermined cycle corresponding to the timing of the oscillation of the balance. The pallet 50 also receives torque from the rotating escape wheel 10 to transmit the torque to the balance.

Figure 5:
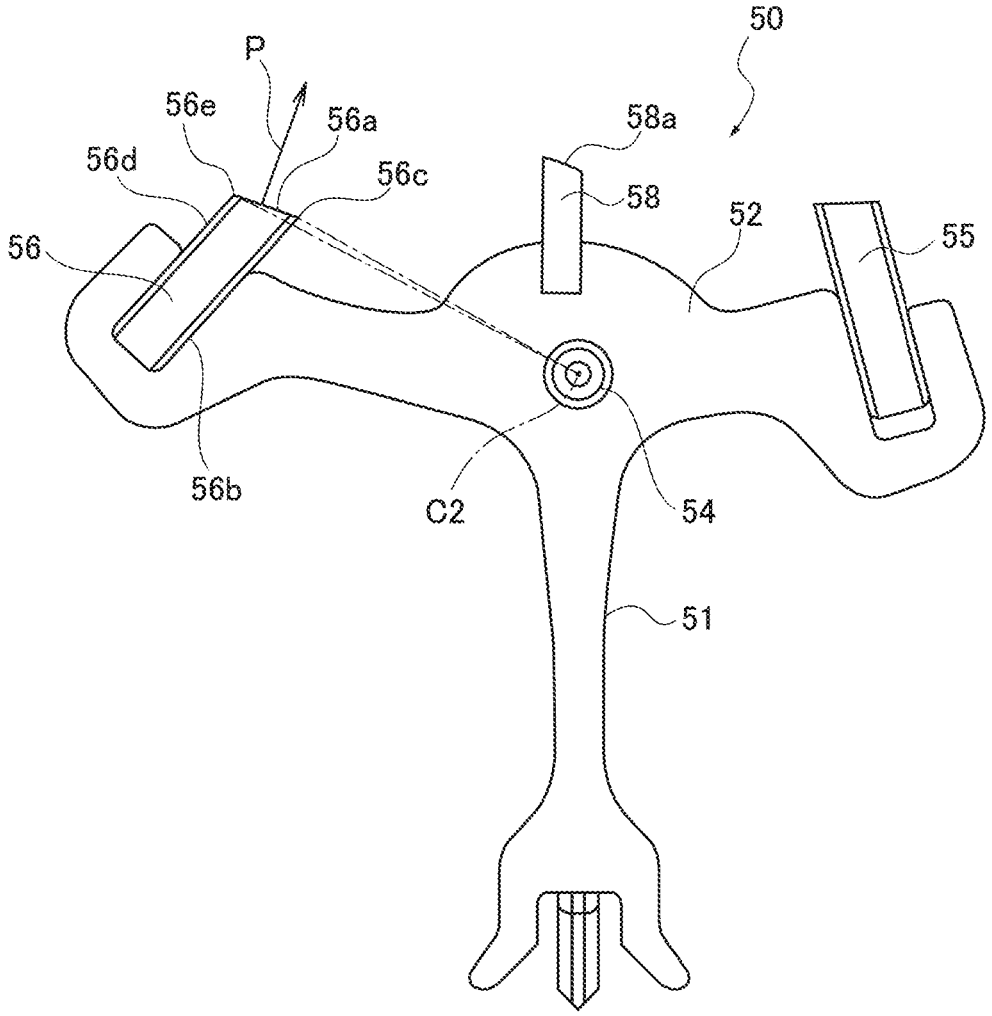
FIG. 5 is a plan view illustrating a pallet in detail.

FIG. 5 is a plan view illustrating the pallet 50 in detail. As shown in FIG. 5, the pallet 50 includes a lever 51 and an arm 52 crossing one end of the lever 51. At the crossing portion, a shaft center C2 of a pallet pivot 54 is provided and the pallet 50 is provided to rotate about the shaft center C2. The arm 52 includes the entry pallet jewel 55 at one end and the exit pallet jewel 56 at the other end. Each of the entry pallet jewel 55 and the exit pallet jewel 56 is made of stone.

The arm 52 includes a third pallet jewel 58 (an example of the torque receiving member) in the vicinity of the pallet pivot 54 (closer than the entry pallet jewel 55 and the exit pallet jewel 56) and between the entry pallet jewel 55 and the exit pallet jewel 56. As shown in FIGS. 3A, 3B, the third pallet jewel 58 contacts the convex portion 13 of the escape wheel 10 at a predetermined timing. The third pallet jewel 58 is made of stone as the entry pallet jewel 55 and the exit pallet jewel 56.

The third pallet jewel 58 is an example of the torque receiving member of the present invention. As will be described below, the thickness of the third pallet jewel 58 in the direction of the shaft center C2 is smaller than those of the entry pallet jewel 55 and the exit pallet jewel 56 so that the third pallet jewel 58 only contacts the convex portion 13 protruding from the end surface 14 of the escape wheel 10.

Unlike the entry pallet jewel 55 and the exit pallet jewel 56, the third pallet jewel 58 is not applied with impact force that stops the rotation of the escape wheel 10 by contacting the tooth 11 of the rotating escape wheel 10. Therefore, the third pallet jewel 58 is not required to have a thickness (dimension along the rotation direction of the escape wheel 10) as large as the entry pallet jewel 55 and the exit pallet jewel 56, and the third pallet jewel 58 is thinner than the entry pallet jewel 55 and the exit pallet jewel 56. Further, the third pallet jewel 58 is disposed at a position where the length from a tip surface 58*a* of the third pallet jewel 58 to the shaft center C2 become shorter than the length form the shaft center C1 to the outer surface of the convex portion 13.

At the other end of the lever 51 opposed to the arm 52, the lever 51 includes a box 53 which is a space to receive the impulse pin 60. The reciprocating impulse pin 60 is inserted into the box 53 and pushes sidewalls which define the box 53. Then, the pallet 50 oscillates in the clockwise direction R1 and the counterclockwise direction R2 about the shaft center C2 of the pallet pivot 54.

To regulate the oscillation angle of the pallet 50 in a predetermined range, two banking pins 81, 82 are provided to contact the side surfaces of the lever 51 to regulate the movement of the pallet 50 when the pallet 50 oscillates by a predetermined angle. The banking pin 82 is provided to regulate the oscillation of the pallet 50 in the clockwise direction R1, while the banking pin 81 is provided to regulate the oscillation of the pallet 50 in the counterclockwise direction R2.

In accordance with the oscillating directions of the escape wheel 10, in the pallet 50, the entry pallet jewel 55 and the exit pallet jewel 56 alternately engage the tooth 11 of the escape wheel 10 to stop the rotation of the escape wheel 10, and disengage from the tooth 11 to release the stop of the escape wheel 10. Thereby, the pallet 50 switches the rotation and the stop of the escape wheel 10, and rotates the escape wheel 10 in the clockwise direction R1 at predetermined intervals.

Right after the entry pallet jewel 55 of the pallet 50 releases the stop of the rotation of the escape wheel 10, the impact surface of the entry pallet jewel 55 contacts a locking corner (a corner defined by an end of the surface 12 of the tooth 11, which is closer to the entry pallet jewel 55 in a state when the entry pallet jewel 55 stops the tooth 11 of the escape wheel 10) of the tooth 11 of the escape wheel 10 and receives impact (torque) from the locking corner of the tooth 11 of the escape wheel 10 in accordance with the rotation of the escape wheel 10 in the clockwise direction R1. Then, the entry pallet jewel 55 of the pallet 50 contacts the surface 12 of the tooth 11 and receives the impact (torque) from the surface 12 in accordance with the rotation of the escape wheel 10 in the clockwise direction R1.

Right after the exit pallet jewel 56 of the pallet 50 releases the stop of the rotation of the escape wheel 10, the exit pallet jewel 56 of the pallet contacts the surface 12 of the tooth 11 of the escape wheel 10 and receives the impact (torque) from the surface 12 in accordance with the rotation of the escape wheel 10 in the clockwise direction R1. Thereby, the pallet 50 applies energy to a balance spring of the balance via the impulse pin 60.

Further, the third pallet jewel 58 starts contacting the convex portion 13 while the exit pallet jewel 56 contacts the tooth 11 of the escape wheel 10 (before ending the contact of the exit pallet jewel 56 and the tooth 11 of the escape wheel 10), and receives the impact (torque) from the convex portion 13 in accordance with the rotation of the escape wheel 10 in the clockwise direction R1. Thereby, the pallet 50 applies energy to the balance spring of the balance via the impulse pin 60.

As opposed to the prior art, an impact surface 56*a* of the exit pallet jewel 56 which receives the impact from the tooth 11 of the escape wheel 10 is inclined to face the outside of the pallet 50. Specifically, as shown in FIG. 5, the impact surface 56*a* of the exit pallet jewel 56 does not face the shaft center C2 which is the oscillating center of the pallet 50. In other words, the normal line P of the impact surface 56*a* extends in a direction away from the shaft center C2.

With the impact surface 56*a* formed as an inclined surface facing the outside of the pallet 50, an inner surface (a side closer from the shaft center C2) (stop surface 56*b* which contacts the tooth 11 to stop the rotation of the escape wheel 10 (see FIG. 2A)) of the exit pallet jewel 56 is formed longer than an outer surface (a side farther away from the shaft center C2) (outer surface 56*d*) of the exit pallet jewel 56, and the impact surface 56*a* is inclined such that the normal line P of the impact surface 56*a* between an end (a locking corner 56*c*, i.e. a corner connecting the impact surface 56*a* and the stop surface 56*b*) of the stop surface 56*b* and an end (a locking corner 56*e*, i.e. a corner connecting the impact surface 56*a* and the outer surface 56*d*) of the outer surface 56*d* extends in the direction away from the shaft center C2.

By forming the impact surface 56*a* to be inclined as explained above, torque is applied from the tooth 11 to the exit pallet jewel 56 with the surface 12 of the tooth 11 of the escape wheel 10 contacting the locking corner 56*c* when the stop of the escape wheel 10 by the exit pallet jewel 56 is released.

On the other hand, the contact between the surface 12 of the tooth 11 of the escape wheel 10 and the locking corner 56*c* of the exit pallet jewel 56 of the pallet 50 is terminated when the rotation of the escape wheel 10 advances and the outer surface of the convex portion 13 starts contacting the tip surface 58*a* of the third pallet jewel 58 of the pallet 50. Then, the contact between the outer surface of the convex portion 13 and the tip surface 58*a* of the third pallet jewel 58 is terminated at a timing before the tooth 11 of the escape wheel 10 contacts the entry pallet jewel 55 to stop the rotation of the escape wheel 10. Torque is applied from the convex portion 13 to the third pallet jewel 58 while the outer surface of the convex portion 13 contacts the tip surface 58*a* of the third pallet jewel 58.

Note that the pallet 50 may be made of silicon and formed by a Deep RIE process or the like as the escape wheel 10.

(Operation of Escapement)

Now, the operation of the escapement 1 for a portable timepiece according to the present embodiment is explained. First, as shown in FIG. 2A, the stop surface 56*b* of the exit pallet jewel 56 of the pallet 50 contacts the tooth 11 of the escape wheel 10 to stop the rotation of the escape wheel 10. From this state, the oscillation of the balance rotates the impulse pin 60 about a shaft center C3 in the clockwise direction R1, and the impulse pin 60 pushes the side wall of the box 53 of the pallet 50 to rotate the pallet 50 about the shaft center C2 in the counterclockwise direction R2 as shown in FIG. 2B. Thereby, the exit pallet jewel 56 starts disengaging from the tooth 11, the rotation of the pallet 50 advances as the rotation of the impulse pin 60 advances, and the stop surface 56*b* of the exit pallet jewel 56 disengages from the tooth 11 as shown in FIG. 2B.

The locking corner 56*c* of the exit pallet jewel 56 contacts the surface 12 of the tooth 11 of the escape wheel 10 since the impact surface 56*a* of the exit pallet jewel 56 is inclined to face the outside of the pallet 50. Then, while the teeth 11 moves in the clockwise direction R1 in accordance with the rotation of the escape wheel 10 in the clockwise direction R1, the locking corner 56*c* keeps contacting the surface 12 of the tooth 11 and accordingly torque that rotates the pallet 50 in the counterclockwise direction R2 is applied from the escape wheel 10 to the exit pallet jewel 56. Note that a period while the torque is being applied from the tooth 11 of the escape wheel 10 to the exit pallet jewel 56 is referred to as a first half period of the impact input.

As shown in FIG. 3A, the surface 12 of the tooth 11 of the escape wheel 10 disengages from the locking corner 56*c* when the escape wheel 10 further rotates, and the outer surface of the convex portion 13 of the escape wheel 10 starts contacting the tip surface 58*a* of the third pallet jewel 58 of the pallet 50.

Then, while the convex portion 13 moves in the clockwise direction R1 in accordance with the rotation of the escape wheel 10 in the clockwise direction R1, the outer surface of the convex portion 13 keeps contacting the tip surface 58*a* of the third pallet jewel 58 as shown in FIG. 3B and accordingly the torque that rotates the pallet 50 in the counterclockwise direction R2 is applied from the escape wheel 10 to the exit pallet jewel 56. Note that a period when the torque is being applied from the convex portion 13 of the escape wheel 10 to the third pallet jewel 58 is referred to as a second half period of the impact input.

As shown in FIG. 4, when the escape wheel 10 further rotates and the outer surface of the convex portion 13 of the escape wheel 10 separates from the tip surface 58*a* of the third pallet jewel 58, another tooth 11 of the escape wheel 10 contacts the stop surface 55*b* of the entry pallet jewel 55 to stop the rotation of the escape wheel 10.

After that, the rotation direction of the balance is reversed to be the counterclockwise direction R2, and accordingly the impulse pin 60 rotating in the counterclockwise direction R2 rotates the pallet 50 about the shaft center C2 in the clockwise direction R1. Thereby, the entry pallet jewel 55 moves away from the tooth 11 to restart the rotation of the escape wheel 10 and the torque is applied to the entry pallet jewel 55 from the tooth 11 of the escape wheel 10. Then, the tooth 11 hits the exit pallet jewel 56 to stop the rotation of the escape wheel 10 as shown in FIG. 2A, and the above-described series of the operation are repeated.

According to the escapement 1 of the present embodiment configured as described above, the torque is applied from the tooth 11 of the escape wheel 10 to the exit pallet jewel 56 of the pallet 50, and the torque is also applied from the convex portion 13 to the third pallet jewel 58. Accordingly, the escapement 1 of the present embodiment can increase the amount of the torque transmitted from the escape wheel 10 to the pallet 50 and improve the energy transmission efficiency.

Here, according to the escapement 1 of the present embodiment, the surface 12 of the tooth 11 of the escape wheel 10 moves while contacting (the locking corner 56*c* of) the exit pallet jewel 56 of the pallet 50 after the stop of the rotation of the escape wheel 10 by the exit pallet jewel 56 is released and the escape wheel 10 starts rotating. At this time, load acting on the exit pallet jewel 56 of the pallet 50 from the tooth 11 of the escape wheel 10 is oriented perpendicular to the surface 12 of the tooth 11 of the escape wheel 10.

With the conventional escapement to which the present invention is not adopted, the impact surface of the exit pallet jewel of the pallet is inclined to face the inside of the pallet (inclined such that the direction of the normal line of the impact surface connecting an end of the inner side and an end of the outer side approaches the center of oscillation since the length of the inner side (a side having a shorter distance from the center of oscillation) of the exit pallet jewel is shorter than the length of the outer side (a side having a longer distance from the center of oscillation) of the exit pallet jewel). Accordingly, after the escape wheel starts rotating, the tooth of the escape wheel moves with the corner of the tooth contacting the impact surface of the exit pallet jewel of the pallet. As a result, the load acting on the exit pallet jewel from the tooth of the escape wheel is oriented perpendicular to the impact surface of the exit pallet jewel.

On the other hand, in the escapement 1 of the present embodiment, the load acting on the exit pallet jewel 56 of the pallet 50 from the tooth 11 of the escape wheel 10 is oriented perpendicular to the surface 12 of the tooth 11 of the escape wheel 10 during the first half period of the impact input. Therefore, in the escapement 1 of the present embodiment, it is possible to increase the torque applied to the pallet 50 compared to the conventional escapement in which the load applied from the escape wheel is oriented perpendicular to the impact surface of the exit pallet jewel.

Here, in the conventional escapement, the balance steps over the center of oscillation during the period when the torque is transmitted from the escape wheel to the exit pallet jewel. In the early period when the torque is transmitted from the escape wheel to the exit pallet jewel (period when the balance approaches the oscillation center), the torque transmitted to the exit pallet jewel acts to shorten the oscillation period of the balance (to advance the timepiece). In the later period (period when the balance is away from the oscillation center) when the torque was transmitted from the escape wheel to the exit pallet jewel, the torque transmitted to the exit pallet jewel from the escape wheel acts to prolong the oscillation period of the balance (to delay the timepiece).

As a result, in the conventional escapement, with regard to the amount of the torque transmitted from the tooth of the escape wheel to the exit pallet jewel of the pallet, the amount of the torque transmitted to advance the timepiece is larger than the amount of the torque transmitted to delay the timepiece.

On the other hand, in the escapement 1 of the present embodiment, the transmission period of the torque from the escape wheel 10 to the pallet 50 is divided into the first half period and the second half period of the impact input. The first half period is set as a period when the torque is transmitted from the tooth 11 of the escape wheel 10 to the pallet 50, and the second half period is set as a period when the torque is transmitted from the convex portion 13 of the escape wheel 10 to the third pallet jewel 58.

In the first half period, increasing the torque transmitted from the tooth 11 of the escape wheel 10 to the exit pallet jewel 56 of the pallet 50 as described above can increase the amount of the transmitted torque which acts to advance the timepiece in the first half period.

Therefore, it is possible to approximate a ratio of the torque acting to advance the timepiece among the torque transmitted from the escape wheel 10 to the pallet 50 to a ratio of the torque acting to delay the timepiece, and also possible to reduce the error of the escapement 1 by balancing the advancement and the delay of the timepiece.

Note that the escapement for the timepiece according to the present invention does not exclude an escapement having the impact surface of the exit pallet jewel of the pallet inclined to face the inside of the pallet.

Further, in the escapement 1 of the present embodiment, each convex portion 13 is provided in a portion of the escape wheel 10 where a radial distance between the portion and the shaft center C1 of the escape wheel 10 becomes shorter than a radial distance between the shaft center C1 and the surface 12 of each tooth 11. Optimizing the positions of the convex portions 13 and the third pallet jewel 58 in the escapement 1 as above can increase the torque the convex portion 13 transmits to the pallet 50 compared to the torque the locking corner of the tooth of the escape wheel transmits to the pallet in the conventional escapement.

Therefore, it is possible to easily increase the torque transmission efficiency in the entire period of the impact input from the escape wheel 10. The escapement for the timepiece according to the present invention does not exclude an escapement in which the torque applying member for applying the torque from the escape wheel is provided in a portion of the escape wheel where the radial distance between the portion and the shaft center of the escape wheel becomes longer than the radial distance between the surface of each tooth and the shaft center, or provided in a portion where the radial distances become equal.

Further, in the escapement 1 according to the present embodiment, the convex portion 13 and the third pallet jewel 58 are arranged to contact each other before the contact between the tooth 11 of the escape wheel 10 and the exit pallet jewel 56 is terminated. Therefore, the transmission of the torque from the escape wheel 10 to the pallet 50 can be secured for a long time without interruption.

In the escapement 1 according to the present embodiment, the convex portions 13 are provided on the escape wheel 10 to protrude from the end surface 14 of the escape wheel 10. Accordingly, it is possible for the convex portions 13 to avoid contacting the entry pallet jewel 55 and the exit pallet jewel 56, which may be occurred in the case where the convex portions 13 are provided to radially extend from the escape wheel 10.

In addition, it is also possible to avoid restrictions on the shape and arrangement of the convex portions 13 not to contact the entry pallet jewel 55 and the exit pallet jewel 56 since the convex portions 13 are provided on the escape wheel 10 to protrude from the end surface 14 of the escape wheel 10.

Figure 6A:
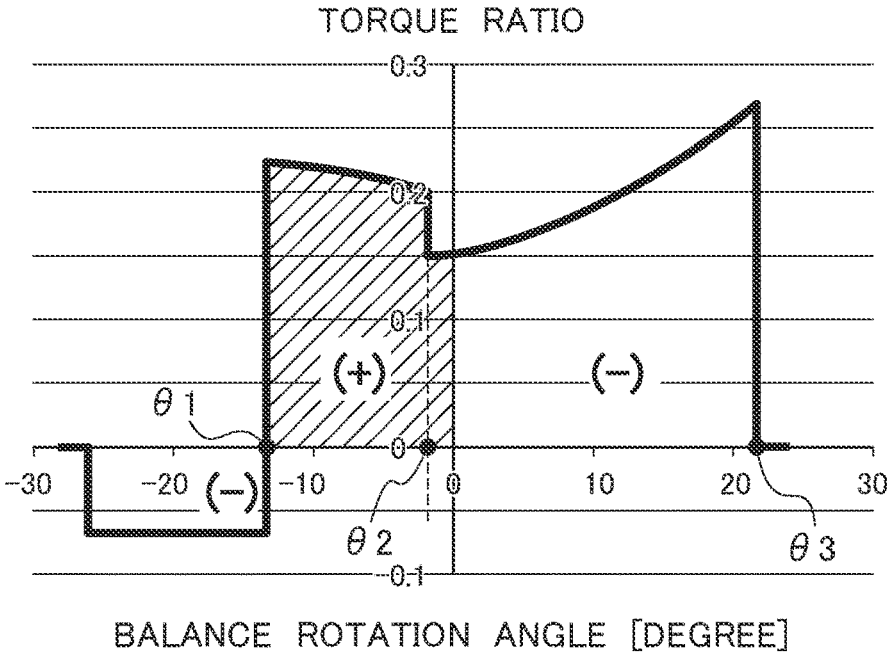
FIG. 6A is a graph showing a torque ratio to the rotation angle of the balance with respect to the exit pallet jewel according to the escapement of the embodiment.
Figure 6B:
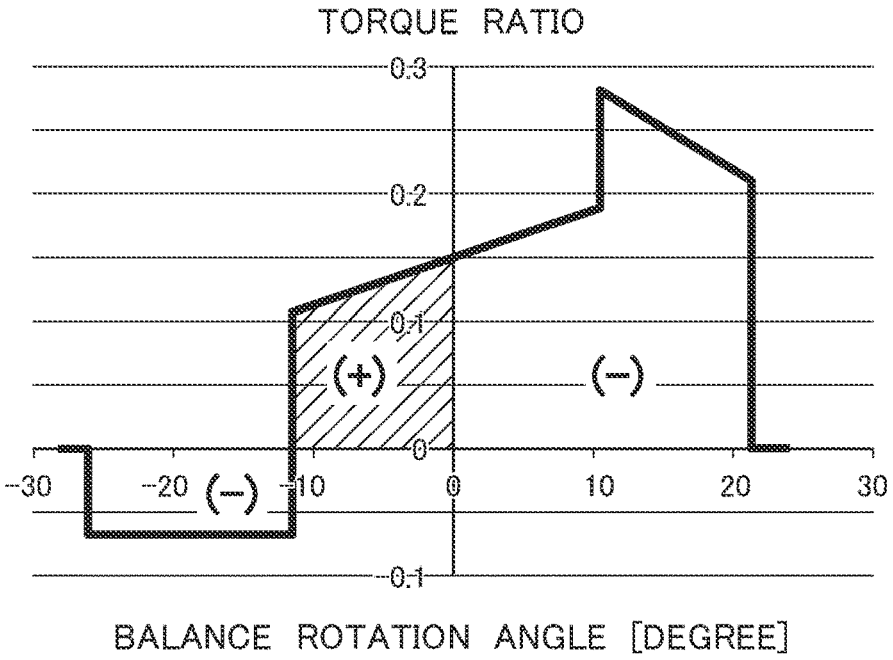
FIG. 6B is a graph showing a torque ratio to the rotation angle of the balance with respect to the exit pallet jewel according to the escapement of a comparative example.

FIG. 6A is a graph showing a torque ratio to the rotation angle of the balance with respect to the exit pallet jewel 56 according to the escapement 1 of the present embodiment. FIG. 6B is a graph showing a torque ratio to the rotation angle of the balance with respect to the exit pallet jewel 56 according to the escapement of a comparative example (prior art).

In FIG. 6A, the rotation angle θ1[°] of the balance corresponds to a start position of the first half period of the impact input shown in FIG. 2B. The rotation angle θ2[°] of the balance corresponds to a switching position between the first half period and the second half period of the impact input shown in FIG. 3A The rotation angle θ3[°] of the balance corresponds to an end position of the second half period of the impact input (i.e. a position corresponding to a timing when the convex portion 13 separates from the third pallet jewel 58) shown in FIG. 3B. In FIG. 6A, a position in which the rotation angle of the balance is 0[°] corresponds to the oscillation center of the balance.

The escapement 1 according to the present embodiment shows the torque ratio of FIG. 6A. Here, a range in which the rotation angle of the balance is negative and the torque ratio is positive, that is, a range from θ1[°] to 0[°] of the rotation angle of the balance corresponds to the torque ratio acting to advance the timepiece (shown with +).

On the other hand, a range in which the rotation angle of the balance is negative and the torque ratio is negative, that is, a range from −27, −26[°] to θ1[°] of the rotation angle of the balance corresponds to the torque ratio acting to delay the timepiece (shown with −). In addition, a range in which the rotation angle of the balance is positive and the torque ratio is positive, that is, a range from 0[°] to θ3[°] of the rotation angle of the balance also corresponds to the torque ratio acting to delay the timepiece (shown with −).

The escapement according to the comparative example (prior art) to which the present invention is not adopted shows the torque ratio of FIG. 6B. The escapement of the comparative example has the same configuration as the escapement 1 according to the present embodiment with exceptions that the escape wheel does not include the convex portions 13, the pallet 50 does not include the third pallet jewel 58, and the impact surface 56*a* of the exit pallet jewel 56 faces the inside of the pallet 50.

Now, referring to FIGS. 6A, 6B, the torque ratio of the escapement 1 according to the present embodiment and the torque ratio of the escapement according to the comparative example are compared. In the escapement 1 of the present embodiment, difference between the area of the positive torque ratio (hatched portion in the drawing) and the area of the negative torque ratio becomes smaller compared to the escapement of the comparative example. Thus, the torque transmission efficiency from the escape wheel 10 to the pallet 50 is improved.

Further, in the escapement 1 according to the present embodiment, a ratio of the torque ratio acting to advance the timepiece (shown with +) relative to the torque ratio acting to delay the timepiece (shown with −) increases and the error of the escapement 1 is reduced compared to the escapement of the comparative example.

Note that as the convex portion 13 is formed at a position closer to the axis center C 1, the torque of the escape wheel 10 is more easily transmitted to the pallet 50, which is preferable in terms of improving the energy transmission efficiency.

On the other hand, however, the convex portion 13 cannot apply the torque to the tip surface 58*a* of the third pallet jewel 58 unless the convex portion 13 moves a longer distance relative to the tip surface 58*a* of the third pallet jewel 58 the convex portion 13 contacts compared to that of the third pallet jewel 58 which moves in accordance with the oscillation of the pallet 50. As the positions of the convex portions 13 approach the shaft center C1, the moving distance of each convex portion 13 decreases.

Figure 7A:
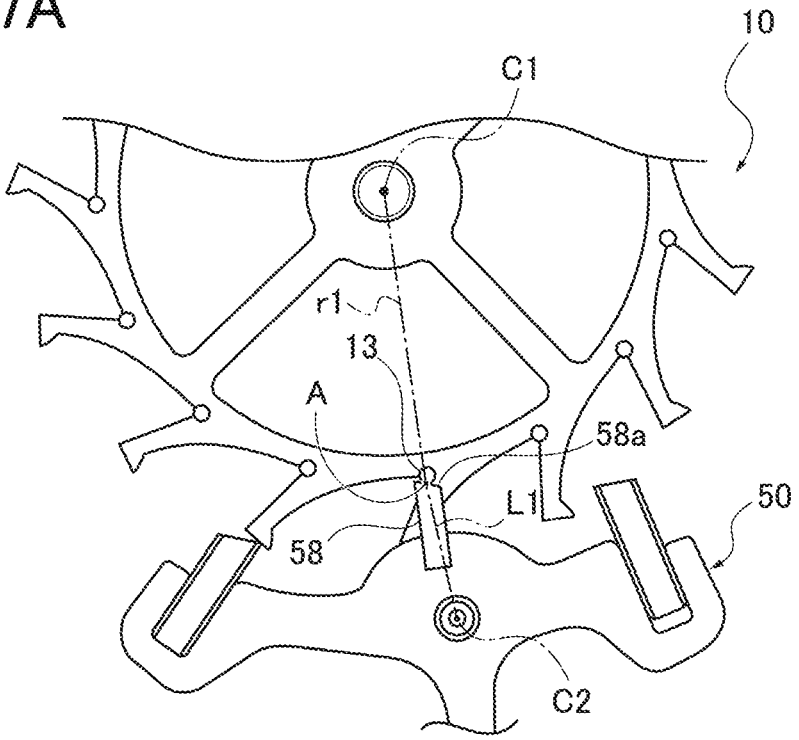
FIG. 7A is a view illustrating an example of a condition for transmitting torque from a convex portion to a third pallet jewel, and a state in which the convex portion and the third pallet jewel start contacting each other.
Figure 7B:
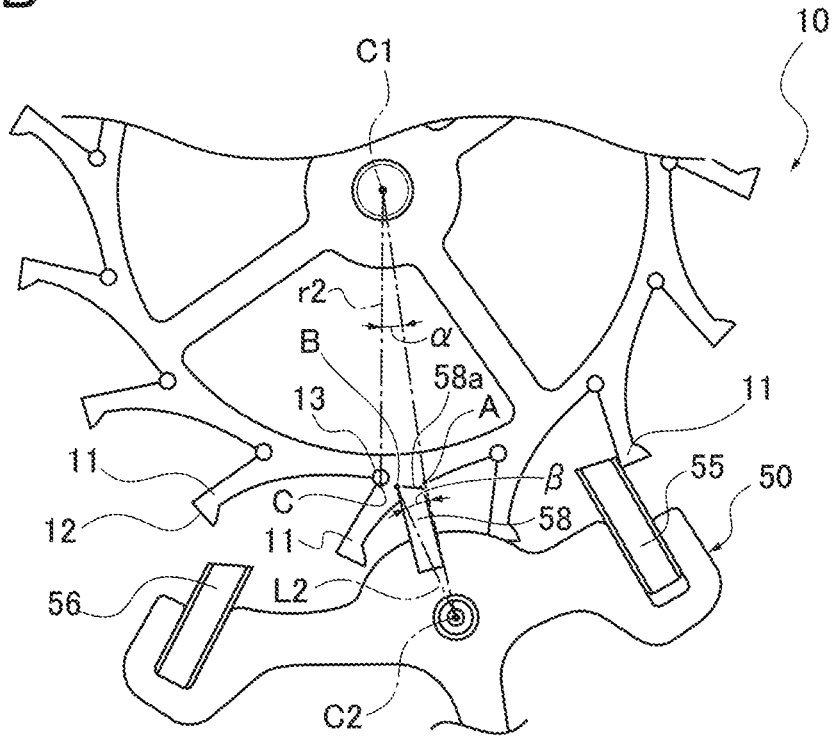
FIG. 7B is a view illustrating an example of a condition for transmitting torque from the convex portion to the third pallet jewel, and a state in which the contact between the convex portion and the third pallet jewel is terminated and the entry pallet jewel stops the escape wheel.

FIG. 7A is a view illustrating an example of a condition for transmitting the torque from the convex portion 13 to the third pallet jewel 58, and shows a state in which the convex portion 13 and the third pallet jewel 58 start contacting each other. FIG. 7B is a view illustrating an example of a condition for transmitting the torque from the convex portion 13 to the third pallet jewel 58, and shows a state in which the contact between the convex portion 13 and the third pallet jewel 58 is terminated and the entry pallet jewel 55 stops the escape wheel 10.

Here, as shown in FIG. 7A, a portion in which the convex portion 13 and the third pallet jewel 58 start contacting each other is shown with A. Further, as shown in FIG. 7B, in the state in which the contact between the convex portion 13 and the third pallet jewel 58 is terminated and the entry pallet jewel 55 stops the escape wheel 10, a leaving corner (corner corresponding to an end of the tip surface 58*a* where the contact of the tip surface 58*a* relative to the third pallet jewel 58 is terminated) is shown with B, and a portion of the convex portion 13 farthest from the shaft center C1 is shown with C. Note that the portion C is a contacting point in the convex portion 13 relative to the tip surface 58*a* of the third pallet jewel 58 when the contact to the third pallet jewel 58 is terminated.

Defining that the rotation angle of the escape wheel 10 during the period from the start of the contact between the convex portion 13 and the third pallet jewel 58 to the stop of the escape wheel 10 by the entry pallet jewel 55 is α (∠AC1C), the rotation angle of the pallet 50 during the period from the start of the contact between the convex portion 13 and the third pallet jewel 58 to the stop of the escape wheel 10 by the entry pallet jewel 55 is β (∠BC2C), a length between the portion A and the shaft center C1 at the start of the contact is r1, a length between the portion B and the shaft center C2 at the start of the contact is L1, a length between the portion C and the shaft center C1 when the entry pallet jewel 55 stops the escape wheel 10 is r2, and a length between the portion C and the shaft center C2 when the entry pallet jewel 55 stops the escape wheel 10 is L2, the length AC and the length BC are calculated as follows.

The length AC calculated as below can be designed to be longer than the length BC.

$$AC=\{(r1)^2+(r2)^2-2(r1)(r2)\cos\alpha\}^{1/2}$$

$$BC=\{(L1)^2+(L2)^2-2(L1)(L2)\cos\beta\}^{1/2}$$

Figure 8:
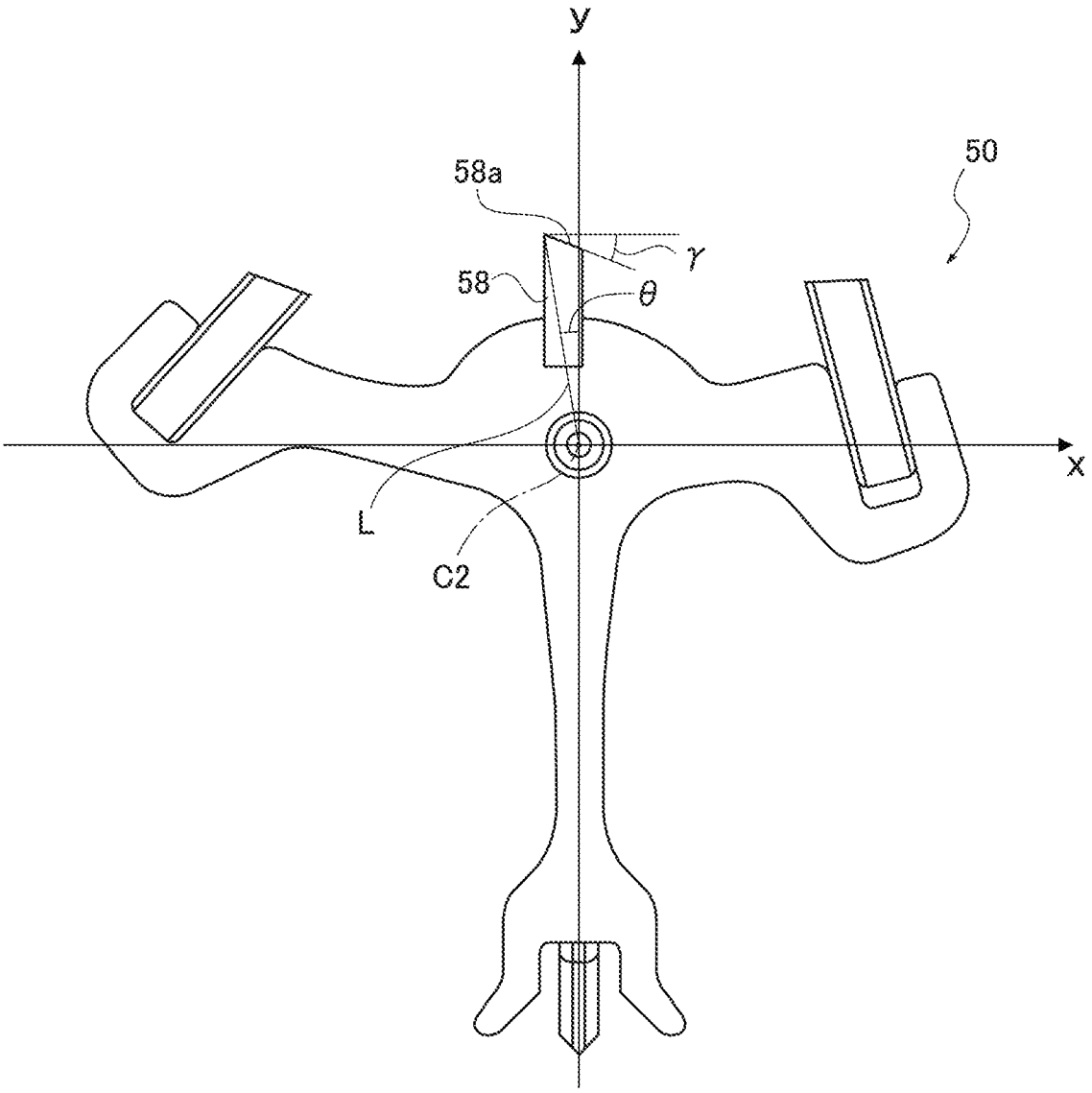
FIG. 8 is a view illustrating an example of the pallet of the escapement according to the embodiment.

FIG. 8 is a view illustrating an example of the pallet 50 of the escapement 1 according to the present embodiment. Assuming that, for example, a length C1 C2 between the shaft center C1 of the escape wheel 10 and the shaft center C2 of the pallet 50 is 2800[μm], the convex portion 13 in the cylindrical shape has a center at a position where a length from the shaft center C1 becomes 1800[μm] and a diameter of 100[μm], the side surface of the third pallet jewel 58 closer to the entry pallet jewel 55 is aligned with the Y-axis which connects the shaft center C1 and the shaft center C2 as shown in FIG. 8, the end edge of the tip surface 58*a* on the side of the exit pallet jewel 56 is placed at a location having a radial distance L (=1013[μm]) from the shaft center C2 and having an angle θ (=11.00[° ]) with respect to the Y-axis, the lengths r1, r2, L1, L2 and the angles α, β are calculated as follows. Note that the tip surface 58*a* of the third pallet jewel 58 is formed to be inclined in a descending direction toward the right at an angle$_Y$ (=21.6[° ]) relative to the X-axis perpendicular to the Y-axis.

The lengths r1, r2, L1, L2 and the angles α, β are calculated as follows.

$r1=1847$ [μm]

$r2=1850$ [μm]

$L1=959$ [μm]

$L2=1013$ [μm]

$\alpha=7.47$[°]

$\beta=12.28$[°]

Accordingly, the length AC is 241 [μm], the length BC is 217 [μm], and BC<AC is satisfied. The specific numerical values listed above are merely examples, and numerical values other than above can be adopted if the values satisfy BC<AC.

(Variations)

In the escapement 1 of the embodiment, the convex portion 13 is formed in the short cylindrical shape. However, the contour shape of the outer surface of the cylindrical convex portion 13 is not limited to the circular shape. In addition, the tip surface 58*a* of the third pallet jewel 58 may be inclined in any direction.

Figure 9A:
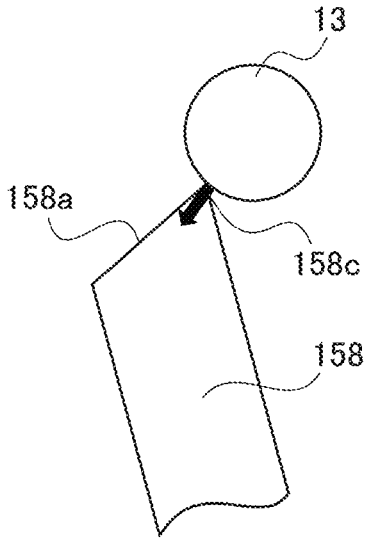
FIG. 9A is a pattern diagram illustrating another example of the convex portion and the third pallet jewel as an example of a torque applying and receiving member in the escapement of the present invention, and illustrating the combination of a cylindrical convex portion and a third pallet jewel having a tip surface which is inclined in the different direction.
Figure 9B:
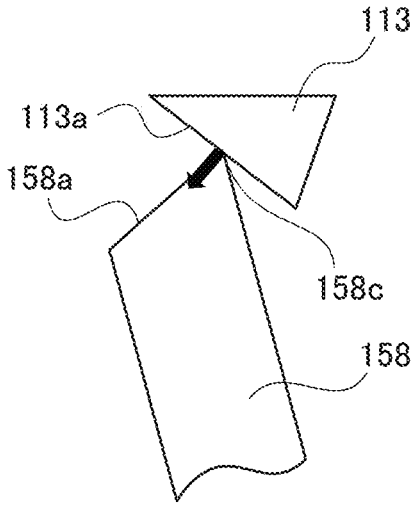
FIG. 9B is a pattern diagram illustrating another example of the convex portion and the third pallet jewel as an example of the torque applying and receiving member in the escapement of the present invention, and illustrating the combination of a convex portion in a triangular prism shape and the third pallet jewel having the tip surface which is inclined in the different direction.
Figure 9C:
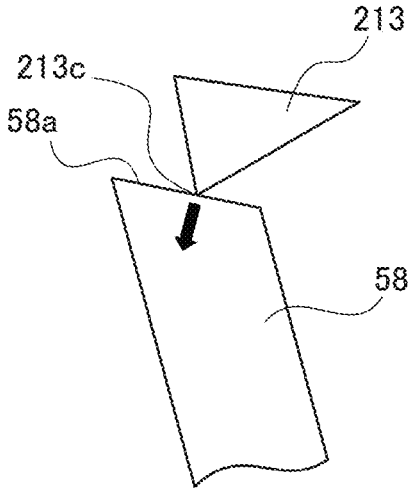
FIG. 9C is a schematic plan view illustrating another example of the convex portion and the third pallet jewel as an example of the torque applying and receiving member in the escapement of the present invention, and illustrating the combination of the convex portion in the triangular prism shape and the third pallet jewel shown in FIG. 5.

FIG. 9A is a pattern diagram illustrating a convex portion 13 and a third pallet jewel 158 as another example of a torque applying and receiving member in the escapement of the present invention, and specifically illustrating the combination of the cylindrical convex portion 13 and the third pallet jewel 158 having a tip surface 158*a* which is inclined in the different direction from that of the third pallet jewel 58. FIG. 9B is a pattern diagram illustrating a convex portion 113 and a third pallet jewel 158 as another example of the torque applying and receiving member in the escapement of the present invention, and specifically illustrating the combination of the convex portion 113 in a triangular prism shape and the third pallet jewel 158 having the tip surface 158*a* which is inclined in the different direction from that of the third pallet jewel 58. FIG. 9C is a pattern diagram illustrating a convex portion 213 and a third pallet jewel 58, as another example of the torque applying and receiving member in the escapement of the present invention, and specifically illustrating the combination of the convex portion 213 in a triangular prism shape and the third pallet jewel 58 shown in FIG. 5.

As shown in FIG. 9A, for example, the torque applying and receiving member of the escapement according to the present invention may include the convex portion 13 formed in the shorter cylindrical shape and the third pallet jewel 158 having the tip surface 158*a* which is inclined in the different direction from that of the tip surface 58*a* shown in FIG. 5 such that the outer surface of the convex portion 13 pushes a corner 158*c* connected to an end of the tip surface 158*a* in the third pallet jewel 158 in a direction shown with an arrow to apply the torque from the convex portion 13 to the third pallet jewel 158. The contour shape of the outer surface of the convex portion is not necessarily circular, and may be an elliptical shape or a curved shape whose curvature is undefined.

As shown in FIG. 9B, for example, the torque applying and receiving member of the escapement according to the present invention may include the convex portion 113 formed in a triangular prism shape and the third pallet jewel 158 having the tip surface 158*a* which is inclined in the different direction from that of the tip surface 58*a* shown in FIG. 5 such that the flat portion of the outer surface of the convex portion 113 pushes the corner 158*c* connected to one end of the tip surface 158*a* in the third pallet jewel 158 in a direction shown with an arrow to apply the torque from the convex portion 113 to the third pallet jewel 158.

Alternatively, as shown in FIG. 9C, for example, the torque applying and receiving member of the escapement according to the present invention may include the convex portion 213 formed in the triangular prism shape and the third pallet jewel 58 shown in FIG. 5 such that the corner 213*c* of the outer surface of the convex portion 213 pushes the tip surface 58*a* of the third pallet jewel 58 in a direction shown with an arrow to apply the torque from the convex portion 213 to the third pallet jewel 58.

The convex portion 13, 113, 213 does not need to protrude as a solid mass as shown in FIG. 1. In other words, the convex portion 13, 113, 213 may include only a surface or a portion that contacts and pushes the tip surface 58*a*, 158*a* of the third pallet jewel 58, 158, that is the convex portion may include only the outer surface (i.e. a plate wall surface) of the convex portion 13, 113, 213.

In the escapement 1 according to the first embodiment or the variations, each of the entry pallet jewel 55, the exit pallet jewel 56, and the third pallet jewel 58 provided on the pallet 50 is made of stone different from the material of the lever 51 and the arm 52 which are parts of the body of the pallet 50. However, in the escapement according to the present invention, the entry pallet jewel, the exit pallet jewel, and the third pallet jewel may be formed integrally with the body of the pallet with the same material (for example, silicon, metal, etc.).

Figure 10:
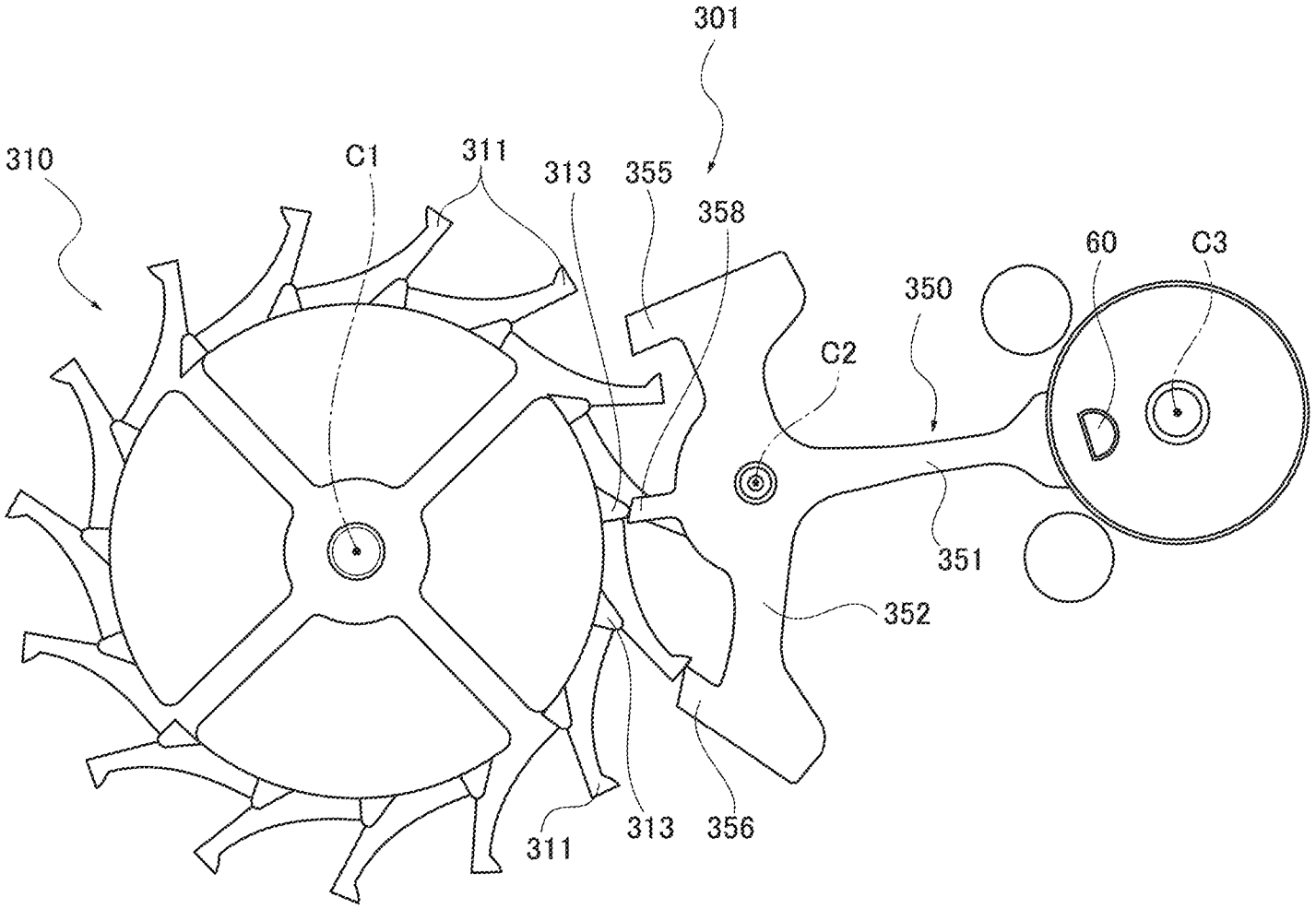
FIG. 10 is a perspective view illustrating an escapement including another escape wheel and another pallet instead of the escape wheel and the pallet of the escapement shown in FIG. 1.

FIG. 10 is a perspective view illustrating an escapement 301 including an escape wheel 310 and a pallet 350 instead of the escape wheel 10 and the pallet 50 of the escapement 1 shown in FIG. 1. The escapement 301 is another embodiment of the present invention. In the pallet 350 of the escapement 301, a lever 351, an arm 352, an entry pallet jewel 355, an exit pallet jewel 356 and a third pallet jewel 358 are integrally formed with a material such as silicon or the like. Further, the escape wheel 310 of the escapement 301 includes convex portions 313 each formed in a substantially triangular prism shape instead of the convex portions 13 each formed in the short cylindrical shape. According to the escapement 301 configured as described above, an operation and an effect similar to those of the escapement 1 shown in FIG. 1 can be achieved.

In the escapement according to the embodiments or the variations described above, one convex portion and one third pallet jewel as an example of the torque applying and receiving member are disposed between adjacent two teeth 11, 11, and between the exit pallet jewel and the third pallet jewel, respectively. However, two or more convex portions and two or more third pallet jewels may be disposed between the two teeth and between the jewels respectively to increase the energy transmission efficiency.

On the other hand, as the number of the torque applying and receiving members disposed between adjacent two teeth 11, 11, and between the exit pallet jewel and the third pallet jewel increase, respectively, it becomes more difficult to accurately adjust the timing and the like of the contact of the torque applying and receiving members. Accordingly, the number of the torque applying and receiving members to be disposed may be determined based on the balance between energy transmission efficiency to be improved and cost required for adjusting the accuracy.

Second Embodiment

Hereinafter, the second embodiment (Embodiment II) of an escapement for a timepiece according to the present invention is described with reference to drawings.

(Configuration of Escapement)

Figure 11:
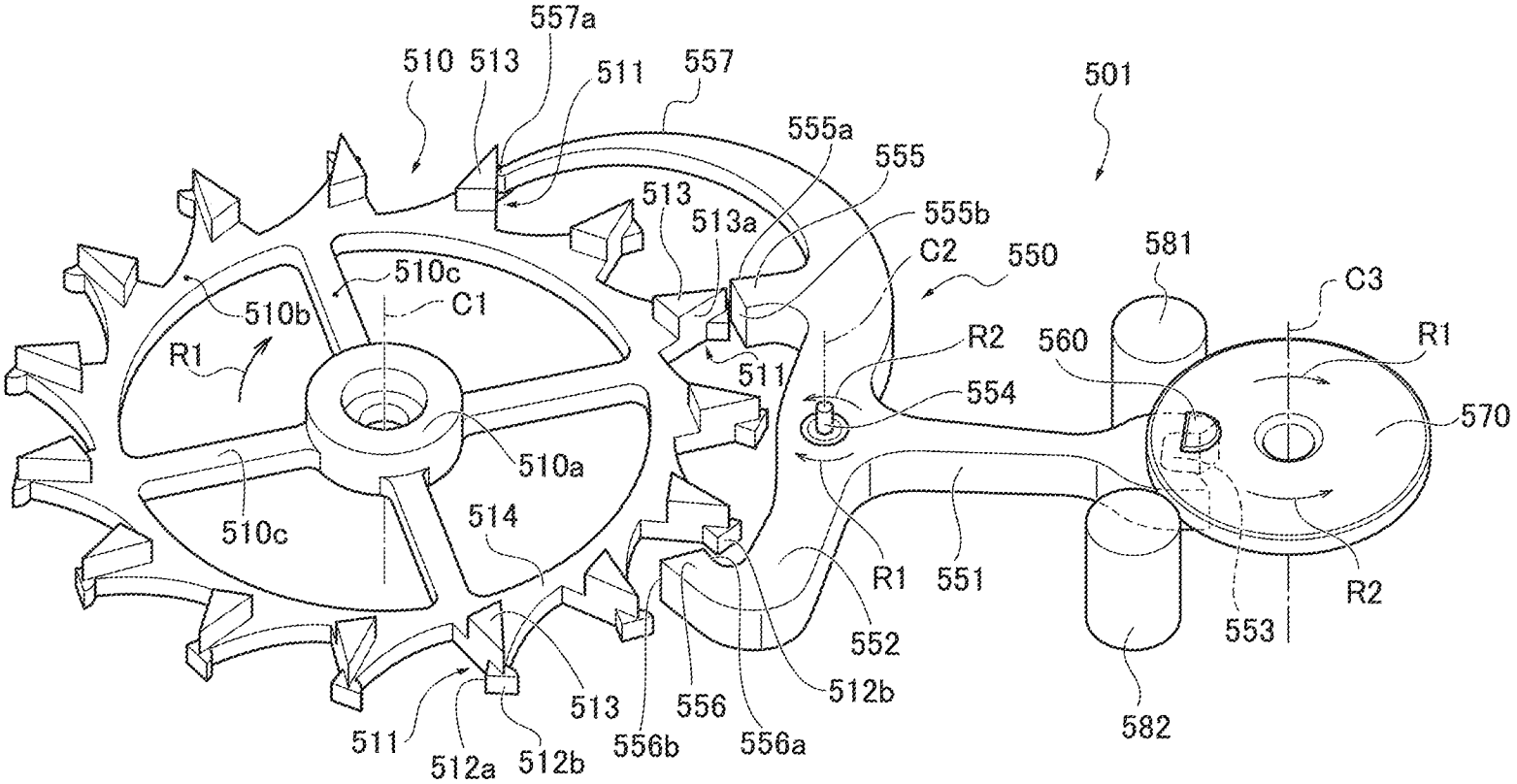
FIG. 11 is a perspective view illustrating an escapement for a portable timepiece (a wristwatch, for example) according to an embodiment (second embodiment) of the present invention.
Figure 12A:
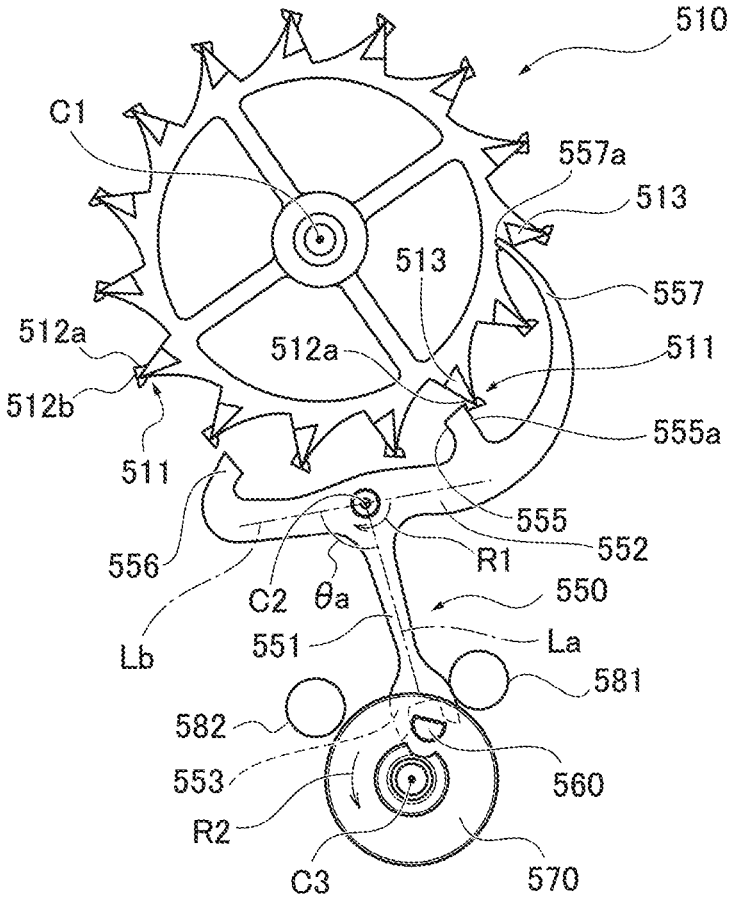
FIG. 12A is a plan view illustrating the operation of the escapement and a state in which an entry pallet jewel stops an escape wheel.
Figure 12B:
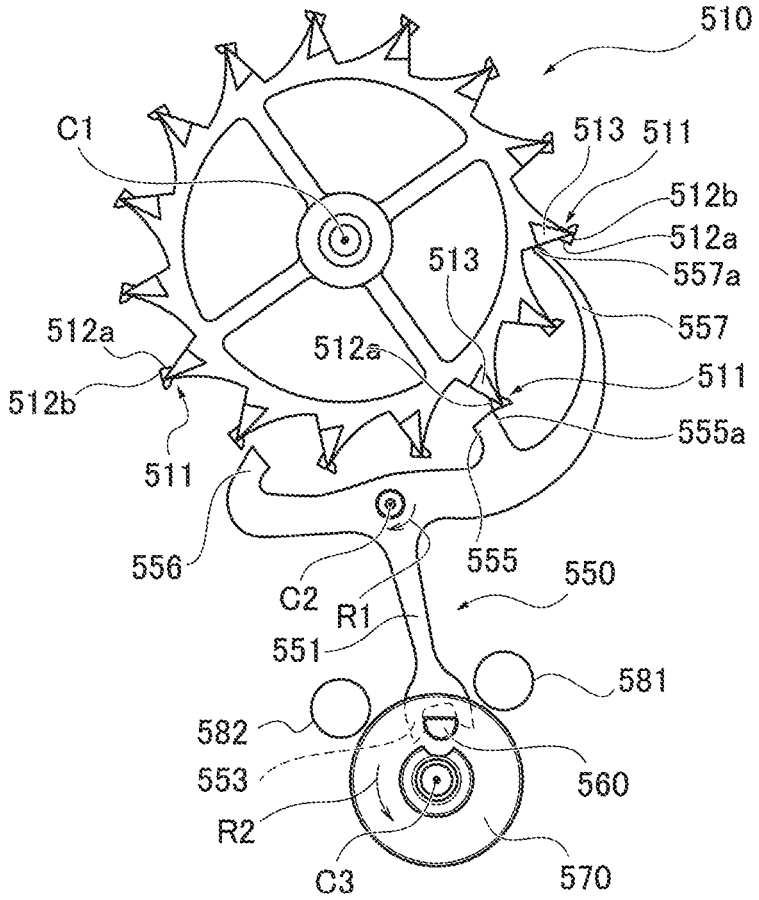
FIG. 12B is a plan view illustrating the operation of the escapement and a state right before the entry pallet jewel disengages from a tooth of the escape wheel.
Figure 12C:
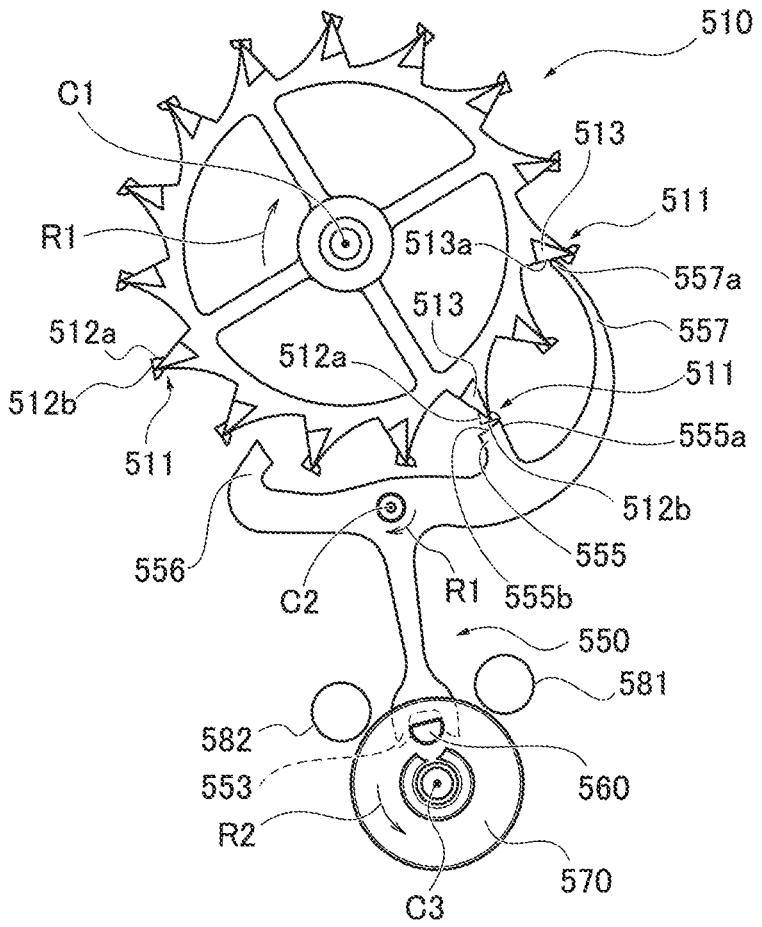
FIG. 12C is a plan view illustrating the operation of the escapement and a state in which the escape wheel rotates after the entry pallet jewel disengaged from the tooth of the escape wheel, and an arm portion contacts a convex portion of the escape wheel.
Figure 12D:
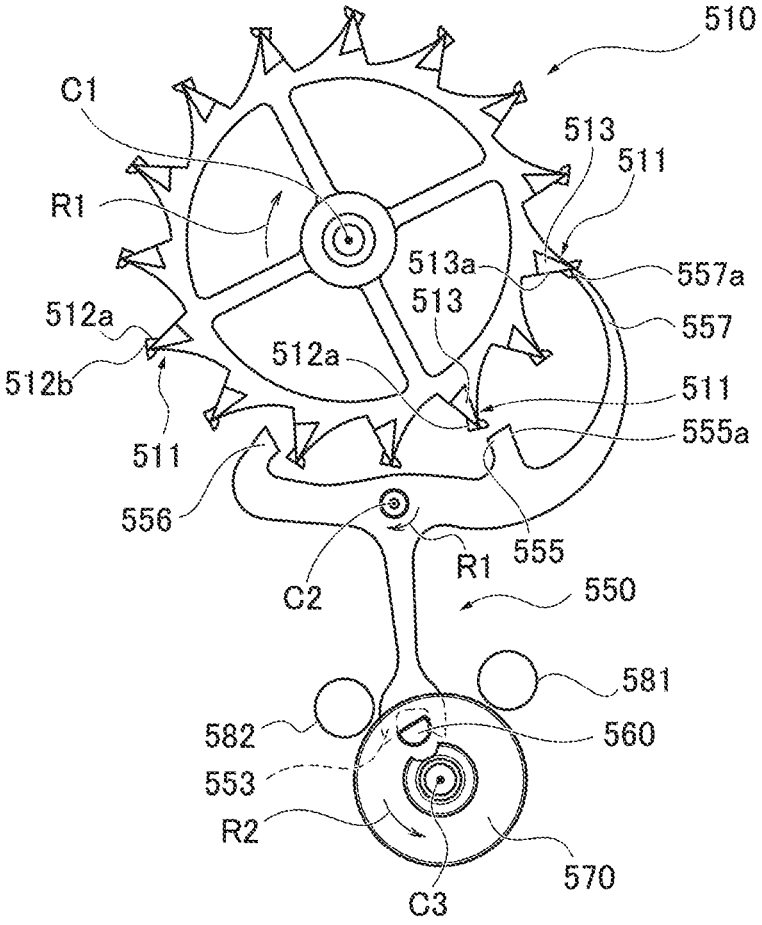
FIG. 12D is a plan view illustrating the operation of the escapement and a state right before the arm portion disengages from the convex portion of the escape wheel.
Figure 12E:
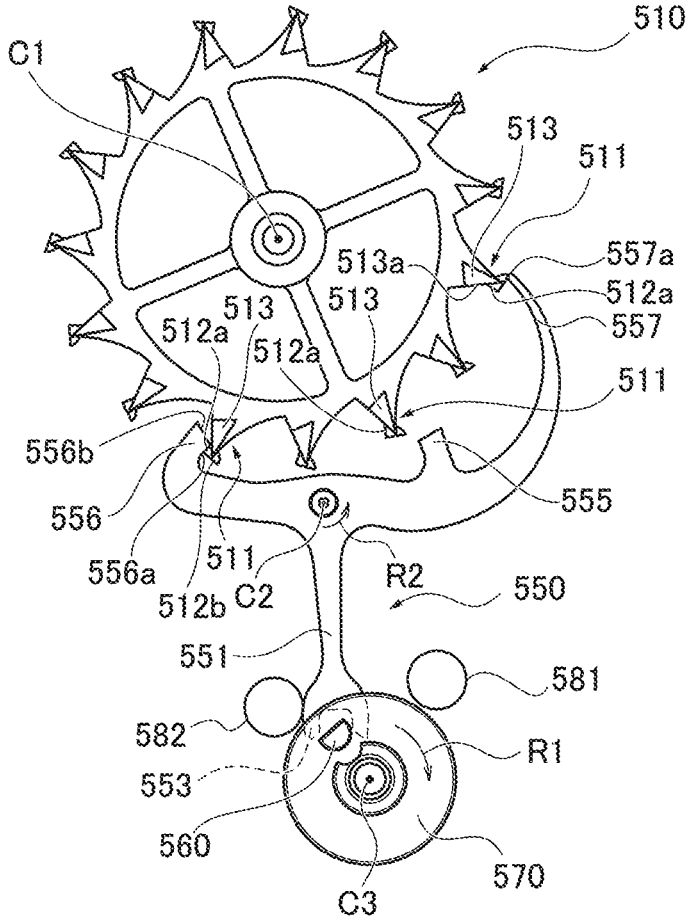
FIG. 12E is a plan view illustrating the operation of the escapement and a state in which the exit pallet jewel stops the escape wheel.

FIG. 11 is a perspective view illustrating an escapement 501 for a portable timepiece (a wristwatch, for example) according to the second embodiment of the present invention. FIGS. 12A to 12E are plan views illustrating the operations of the escapement 501. FIG. 12A shows a state in which an entry pallet jewel 555 stops an escape wheel 510. FIG. 12B shows a state right before the entry pallet jewel 555 disengages from a tooth 511 of the escape wheel 510. FIG. 12C shows a state in which the entry pallet jewel 555 disengages from the tooth 511, the escape wheel 510 rotates and an arm portion 557 contacts a convex portion 513 (torque applying member) of the escape wheel 510. FIG. 12D shows a state right before the arm portion 557 disengages from the convex portion 513 of the escape wheel 510. FIG. 12E shows a state in which an exit pallet jewel 556 stops the escape wheel 510.

As shown in FIG. 11, the escapement 501 is a Swiss lever type escapement including an escape wheel 510, an anchor or pallet 550, and an impulse pin 560. Note that the escape wheel 510 does not apply torque to rotating members other than the pallet 550. Accordingly, as the escapement 1 of the first embodiment, the escapement 501 requires smaller torque for driving than an escapement such as a coaxial escapement in which the escape wheel applies torque to rotating members such as the balance and the like other than the pallet.

(Impulse Pin)

The impulse pin 560 is the same as the impulse pin 60 of the first embodiment.

(Escape Wheel)

The escape wheel 510 is made of silicon and may be formed by a Deep RIE (deep reactive ion etching) process, for example. The escape wheel 510 rotates about the shaft center C1 in the clockwise direction R1 with drive force (energy, torque) applied via a gear train. The escape wheel 510 includes an inner wheel portion 510*a*, an outer wheel portion 510*b*, and four link portions 510*c*. The inner wheel portion 510*a* is located closer to a center of the escape wheel 510 which corresponds to a side of the shaft center C1. The outer wheel portion 510*b* is located farther away from the center. The four link portions 510*c* radially extend to connect the inner wheel portion 510*a* and the outer wheel portion 510*b*. Further, the escape wheel 510 includes a plurality of teeth 511 outwardly extending from the outer wheel portion 510*b* and circumferentially arranged about the shaft center C1 at equal angular intervals. Each of the teeth 11 includes a tip inclined in the rotation direction (clockwise direction R1) of the escape wheel 510.

The escape wheel 510 shown in FIG. 11 includes fifteen teeth 511, for example. The number of the teeth 511 in the escape wheel 510 is not limited to fifteen as in this embodiment, and may be more than or less than fifteen.

The escape wheel 510 stops when a surface 512*a* (hereinafter referred to as a rotating front surface) of each tooth 511 facing the clockwise direction R1 hits a stop surface 555*a* of an entry pallet jewel 555 or a stop surface 556*a* of an exit pallet jewel 556 in accordance with the position of the pallet 550.

In the escape wheel 510, a surface 512*b* (hereinafter referred to as an outer surface) of each tooth 511 which faces the radially outward of the escape wheel 510 contacts a surface 556*b* (hereinafter referred to as an impact surface) of the exit pallet jewel 556 which faces the radially outward thereof in accordance with the position of the pallet 550. When the escape wheel 510 rotates, the outer surface 512*b* and/or the corner of the outer surface 512*b* push the impact surface 556*b* so that torque is applied from the escape wheel 510 to the pallet 550 via the exit pallet jewel 556.

On the other hand, the outer surface 512*b* of the tooth 11 does not contact a surface 555*b* (hereinafter referred to as an outer surface) of the entry pallet jewel 555 which faces the outward direction thereof. Accordingly, the escape wheel 510 does not apply torque to the pallet 550 via the entry pallet jewel 555. The outer surface 512*b* of the tooth 11 does not contact the outer surface 555*b* of the entry pallet jewel 555 since the inclined direction of the outer surface 555*b* is opposite to the inclined direction of the outer surface of the entry pallet jewel in the conventional pallet, which will be described later.

The outer surface of the entry pallet jewel in the conventional pallet is inclined in the same direction as the impact surface 556*b* of the exit pallet jewel 556. When the escape wheel 510 rotates, the outer surface 512*b* and/or the corner thereof push the outer surface of the exit pallet jewel so that torque is applied from the escape wheel 510 to the pallet 550 via the exit pallet jewel. Therefore, the outer surface of the entry pallet jewel in the conventional pallet is an impact surface which receives the torque from the escape wheel 510.

Further, in the escape wheel 510, each tooth 511 provided on the outer wheel portion 510*b* includes a convex portion 513 which is an example of the torque applying member according to the present invention. The number of the convex portions 513 is fifteen which is the same as the number of the teeth 511.

Each of the convex portions 513 protrudes in the direction of the shaft center C1 from an end surface 514 of the escape wheel 510. The end surface 514 extends perpendicular to the shaft center C1. The convex portion 513 has a triangular prism shape and extends to a location which reaches the outer surface 512*b* of each tooth 511. Note that the convex portion 513 may protrude in the radially outward direction beyond the outer surface 512*b* of the tooth 511 or may be retracted in the radially inward direction from the outer surface 512*b*. The convex portion 513 applies torque from the escape wheel 510 to the pallet 550 via a route different from a route from the tooth 511 to the exit pallet jewel 556, which will be described later in detail.

(Pallet)

The pallet 550 is made of silicon and may be formed by a Deep RIE process, for example, as the escape wheel 510. The pallet 550 stops the rotation of the escape wheel 510 at a predetermined cycle corresponding to the timing of the oscillation of the balance, receives torque from the rotating escape wheel 510, and transmits the torque to the balance.

As shown in FIG. 11, the pallet 550 includes a lever 551 and an arm 552 crossing one end of the lever 551 so that the pallet 550 is formed in a substantially T shape. At a portion where the lever 551 and the arm 552 are crossing, a pallet pivot 554 is provided. The pallet 550 is configured to rotate about the shaft center C2 of the pallet pivot 554.

The lever 551 includes a box 553 at the other end of the lever 551. The box 553 is a space to receive the impulse pin 560. The reciprocating impulse pin 560 is inserted into the box 553 and pushes sidewalls which define the box 553 to apply torque to the pallet 550, and the pallet 550 oscillates in the clockwise direction R1 and the counterclockwise direction R2 about the shaft center C2.

To regulate the oscillation angle of the pallet 550 in a predetermined range, two banking pins 581, 582 are provided to contact the side surfaces of the lever 551 to regulate the movement of the pallet 550 when the pallet 550 oscillates by a predetermined angle. The banking pin 582 is provided to regulate the oscillation of the pallet 550 in the clockwise direction R1, while the banking pin 581 is provided to regulate the oscillation of the pallet 550 in the counterclockwise direction R2.

The arm 552 includes the entry pallet jewel 555, the exit pallet jewel 556, and a third pallet jewel 557 (an example of the torque receiving member, and referred to as an arm portion 557 thereinafter). The entry pallet jewel 555 and the arm portion 557 are formed on the opposite side of the exit pallet jewel 556 across the shaft center C2. The entry pallet jewel 555, the exit pallet jewel 556, the arm portion 557, the arm 552, and the lever 551 are integrally formed.

The arm portion 557 is formed on the outside of the entry pallet jewel 555 when viewed from the shaft center C2. The arm portion 557 is curved in an arc shape. The arm portion 557 extends to a position where a distance from the shaft center C2 to a tip portion 557*a* of the arm portion 557 becomes longer than a distance from the shaft center C2 to the outer surface 555*b* of the entry pallet jewel 555. The thickness of the arm portion 557 in the direction of the shaft center C2 is thinner than the thickness of the entry pallet jewel 555 and the exit pallet jewel 556 so that the arm portion 557 does not contact the tooth 511 of the escape wheel 510 but contacts only the convex portion 513.

The tip portion 557*a* contacts the convex portion 513 of the escape wheel 510, and is pushed by the convex portions 513 in accordance with the rotation of the escape wheel 510 so that torque which rotates the pallet 550 in the clockwise direction R1 is applied. The arm portion 557 is an example of the torque receiving member according to the present invention.

The entry pallet jewel 555 and the exit pallet jewel 556 of the pallet 550 alternately engage with the tooth 511 of the escape wheel 510 in accordance with the direction of the oscillation about the shaft center C2 to stop the rotation of the escape wheel 510. Further, the entry pallet jewel 555 and the exit pallet jewel 556 disengage from the tooth 511 so that the stop of the escape wheel 510 is released and the escape wheel 510 restarts the rotation. The pallet 550 switches the rotation and stop of the escape wheel 510 to intermittently rotate the escape wheel 510 at regular intervals.

When the entry pallet jewel 555 stops the escape wheel 510, the pallet 550 rotates in the counterclockwise direction R2 and the stop surface 555*a* of the entry pallet jewel 555 hits the rotating front surface 512*a* of the tooth 511 of the escape wheel 510. From this state, the pallet 550 rotates in the clockwise direction R1 and the entry pallet jewel 555 disengages from the tooth 511 of the escape wheel 510 so that the stop of the escape wheel 510 is released and the escape wheel 510 restarts the rotation.

On the other hand, when the exit pallet jewel 556 stops the escape wheel 510, the pallet 550 rotates in the clockwise direction R1 and the stop surface 556*a* of the exit pallet jewel 556 hits the rotating front surface 512*a* of the tooth 511 of the escape wheel 510. From this state, the pallet 550 rotates in the counterclockwise direction R2 and the exit pallet jewel 556 disengages from the tooth 511 of the escape wheel 510 so that the stop of the escape wheel 510 is released and the escape wheel 510 restarts the rotation.

When the exit pallet jewel 556 disengages from the tooth 511 of the escape wheel 510 and the escape wheel 510 restarts the rotation, the outer surface 512*b* of the tooth 511 pushes the impact surface 556*b* of the exit pallet jewel 556 to apply torque, which oscillates the pallet 550, from the escape wheel 510 to the pallet 550 via the exit pallet jewel 556. With the torque applied to the pallet 550, the side wall defining the box 553 pushes the impulse pin 560 to apply the torque to the balance.

When the entry pallet jewel 555 disengages from the tooth 511 of the escape wheel 510 and the escape wheel 510 restarts the rotation, the outer surface 512*b* of the tooth 511 does not contact the outer surface 555*b* of the entry pallet jewel 555. Accordingly, torque is not applied from the escape wheel 510 to the pallet 550 via the entry pallet jewel 555.

The exit pallet jewel 556 switches the stop of the rotation and the release of the stop (i.e. rotation) of the escape wheel 510 and receives torque from the escape wheel 510, while the entry pallet jewel 555 only switches the stop of the rotation and the release of the stop (i.e. rotation) of the escape wheel 510 but does not receive torque from the escape wheel 510. Note that the entry pallet jewel 555 and the exit pallet jewel 556 contact the tooth 511 of the escape wheel 510 but does not contact the convex portion 513.

The tip portion 557*a* of the arm portion 557 contacts the convex portion 513 of the escape wheel 510 from when the entry pallet jewel 555 disengages from the tooth 511 to restart the rotation of the escape wheel 510 until the exit pallet jewel 556 contacts the tooth 511 to stop the escape wheel 510. Thereby, the convex portion 513 moving with the rotation of the escape wheel 510 pushes the pallet 550 so that the pallet 550 receives torque from the convex portion 513. With the torque applied to the arm portion 557, the side wall defining the box 553 of the pallet 550 pushes the impulse pin 560 to apply the torque to the balance.

Note that the convex portion 513 the tip portion 557*a* of the arm portion 557 contacts is a convex portion 513 formed on the second tooth 511 behind the tooth 511 the entry pallet jewel 555 contacted to stop the escape wheel 510 along the clockwise direction R1 of the escape wheel 510. The convex portion 513 the tip portion 557*a* of the arm portion 557 contacts is not limited to the convex portion 513 formed on the second tooth 511 behind the tooth 511 the entry pallet jewel 555 contacted to stop the escape wheel 510 along the clockwise direction R1 of the escape wheel 510, but may be the first tooth 511 or the third or more tooth 511 behind the tooth 511 the entry pallet jewel 555 contacted.

It is possible to increase the torque ratio of the torque transmitted to the pallet 550 and improve the torque transmission efficiency by configuring the convex portion 513 the tip portion 557*a* contacts to have a long distance from the shaft center C2. However, as the distance from the shaft center C2 increases, it is necessary to elongate a contact surface (front surface 513*a* described later) of the convex portion 513 to ensure a longer contact period.

Unlike the entry pallet jewel 555 and the exit pallet jewel 556, impact force which stops the rotation of the escape wheel 510 by contacting the tooth 511 of the rotating escape wheel 510 is not applied to the arm portion 557. Accordingly, the arm portion 557 is not required to have a thickness (dimension along the clockwise direction R1 of the escape wheel 510) as thick as the entry pallet jewel 555 and the exit pallet jewel 556, so that the arm portion 557 is formed thinner than the entry pallet jewel 555 and the exit pallet jewel 556. Note that the arm portion 557 is formed to have a shape so as not to contact the convex portion 513 at all from when the exit pallet jewel 556 contacts the tooth 511 to stop the escape wheel 510 until the entry pallet jewel 555 disengages from the tooth 511 to restart the rotation of the escape wheel 510.

(Operation of Escapement)

Next, the operation of the escapement 501 for a portable timepiece according to the present embodiment is explained. First, as shown in FIG. 12A, in the escapement 501, the stop surface 555*a* of the entry pallet jewel 555 of the pallet 550 hits the rotating front surface 512*a* of the tooth 11 of the escape wheel 510 to stop the rotation of the escape wheel 510.

From this state, the oscillation of the balance rotates the impulse pin 560 about the shaft center C3 in the counterclockwise direction R2, and the impulse pin 560 pushes the side wall of the box 553 of the pallet 550 to rotate the pallet 550 about the shaft center C2 in the clockwise direction R1 as shown in FIG. 12B. Thereby, the entry pallet jewel 555 starts disengaging from the tooth 511, the rotation of the pallet 550 advances as the rotation of the impulse pin 560 advances. Note that the tip portion 557*a* of the arm portion 557 does not contact the convex portion 513 of the escape wheel 510 while the entry pallet jewel 555 contacts the tooth 11 to stop the rotation of the escape wheel 510 (see FIGS. 12A, 12B).

As shown in FIG. 12C, when the entry pallet jewel 555 disengages from the tooth 511 to release the stop of the rotation of the escape wheel 510, the escape wheel 510 restarts rotating in the clockwise direction R1. The outer surface 555*b* of the entry pallet jewel 555 (which corresponds to the impact surface of the entry pallet jewel of the conventional pallet) does not contact the outer surface 512*b* of the tooth 511 at all while the escape wheel 510 is rotating.

When the escape wheel 510 rotates, from right after the rotation, the tip portion 557*a* of the arm portion 557 contacts the convex portion 513 disposed on the second tooth 511 behind the tooth 511 in the clockwise direction R1 the entry pallet jewel 555 contacted. Specifically, among the circumferential surfaces of the convex portion 513 in the triangular prism shape, the front surface 513*a* contacts the tip portion 557*a* of the arm portion 557.

Then, as shown in FIG. 12D, while the rotation of the escape wheel 10 advances in the clockwise direction R1, the front surface 513*a* pushes the tip portion 557*a* of the arm portion 557 to rotate the pallet 550 in the clockwise direction R1 of the pallet 550 which is the same as the direction when the entry pallet jewel 555 disengaged from the tooth 511. The escape wheel 510 applies the torque to the pallet 550 and the pallet 550 pushes the impulse pin 560 to apply the torque which rotates the balance in the counterclockwise direction R2 and apply energy to the balance spring of the balance.

As shown in FIG. 12E, when the rotation of the escape wheel 10 further advances in the clockwise direction R1, the front surface 513*a* disengages from the tip portion 557*a* of the arm portion 557 to terminate the application of the torque from the escape wheel 510 to the pallet 550 via the arm portion 557. Then, as shown in FIG. 12E, the stop surface 556*a* of the exit pallet jewel 556 contacts the rotating front surface 512*a* of the tooth 11 to stop the rotation of the escape wheel 510, and the lever 551 of the pallet 550 hits the banking pin 582, which prevents the rotation of the pallet 550 in the clockwise direction R1, to stop the rotation of the pallet 550.

The oscillation of the balance switches the direction of the rotation of the impulse pin 60 to the clockwise direction R1 and the pallet 550 rotates about the shaft center C2 in the counterclockwise direction R2. Thereby, the stop surface 556*a* of the exit pallet jewel 556 disengages from the rotating front surface 512*a* of the tooth 511 to release the stop of the rotation of the escape wheel 510 so that the escape wheel 510 restarts rotating in the clockwise direction R1.

When the escape wheel 510 restarts the rotation, the escape wheel 510 rotates with the outer surface 512*b* of the tooth 511, which was stopped by the exit pallet jewel 556, contacting the impact surface 556*b* of the exit pallet jewel 556. Thereby, the torque, which rotates the pallet 550 in the counterclockwise direction R2, is applied to the exit pallet jewel 556. Thus, the pallet 550 receives the torque from the escape wheel 510 and pushes the impulse pin 560 to apply the torque, which rotates the balance in the clockwise direction R1, and apply energy to the balance spring of the balance.

When the escape wheel 510 further rotates in the clockwise direction R1, the outer surface 512*b* of the tooth 511 disengages from the impact surface 556*b* of the exit pallet jewel 556 to terminate the application of the torque from the escape wheel 510 to the pallet 550 via the exit pallet jewel 556.

Then, as shown in FIG. 12A, the stop surface 555*a* of the entry pallet jewel 555 contacts the rotating front surface 512*a* of the tooth 511 to stop the rotation of the escape wheel 510, and the lever 551 of the pallet 550 hits the banking pin 581, which prevents the rotation of the pallet 550 in the counterclockwise direction R2, to stop the rotation of the pallet 550. From this state, the escapement 501 repeats the above-described series of the operations.

As described above, according to the escapement 501 of the present embodiment, the distance from the shaft center C2 to the tip portion 557*a* of the arm portion 557 is longer than the distance from the shaft center C2 to the portion of the entry pallet jewel 555 which contacts the escape wheel 510, and the pallet 550 receives the torque from the escape wheel 510 at the tip portion 557*a* of the arm portion 557. Therefore, it is possible to increase the torque ratio of the torque applied from the escape wheel 510 to the pallet 550 and to improve the transmission efficiency of the torque from the escape wheel 510 to the pallet 550. That is, the escapement 501 can improve the transmission efficiency of torque compared to the conventional Swiss lever type escapement.

Further, in the escapement 501 of the present embodiment, the tip portion 557*a* of the arm portion 557 which receives the torque from the escape wheel 510 instead of the entry pallet jewel 555 is located closer to the entry pallet jewel 555 than the exit pallet jewel 556 to receive the torque which rotates the pallet 550 in the same direction as the rotation direction of the pallet 550 when the entry pallet jewel 555 disengaged from the tooth 11 of the escape wheel 510. Therefore, the torque can be applied from the escape wheel 510 to the arm portion 557 without preventing the rotation of the pallet 550 when the entry pallet jewel 555 disengages from the tooth 11.

Figure 13A:
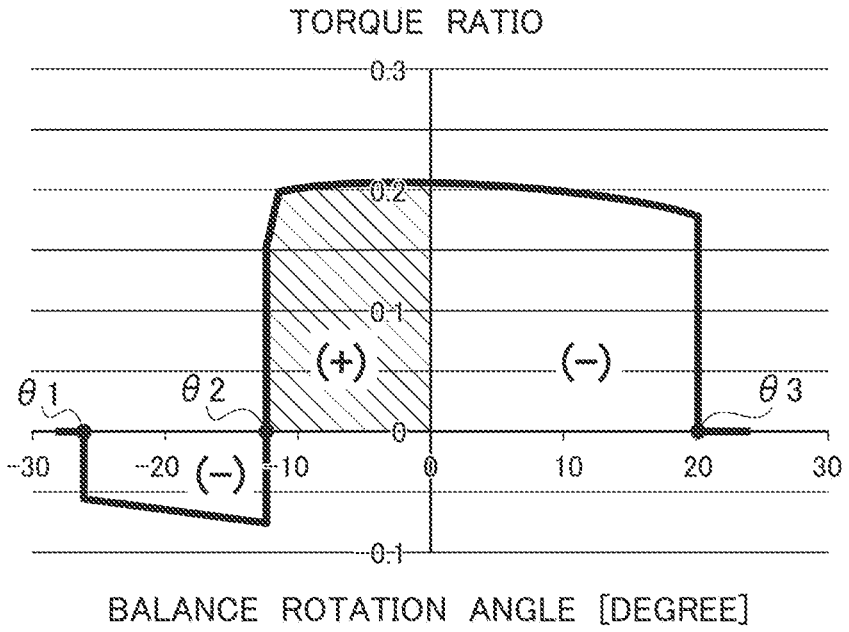
FIG. 13A is a graph showing a torque ratio to the rotation angle of the balance with respect to an arm portion according to the escapement of the present embodiment, which receives torque at the arm portion.
Figure 13B:
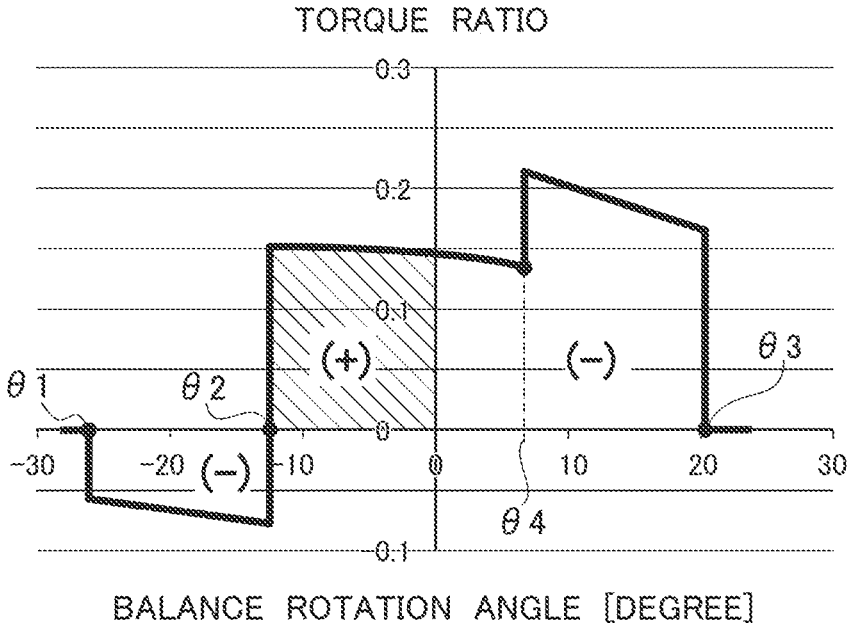
FIG. 13B is a graph showing a torque ratio to the rotation angle of the balance with respect to the entry pallet jewel according to the conventional escapement of a comparative example, which receives torque at an impact surface of the entry pallet jewel.

FIG. 13A is a graph showing a torque ratio (torque of the balance/torque of the escape wheel) to the rotation angle of the balance with respect to the clockwise direction R1 of the pallet 550 according to the escapement 501 which receives the torque at the arm portion 557. FIG. 13B is a graph showing a torque ratio to the rotation angle of the balance with respect to the clockwise direction R1 of the pallet according to the conventional escapement, which receives the torque at the impact surface of the entry pallet jewel, as a comparative example. Note that a position where the rotation angle of the balance is 0[°] in FIGS. 13A, 13B corresponds to the oscillation center of the balance.

As shown in FIG. 13A, with regard to the escapement 501 of the present embodiment, a range in which the rotation angle of the balance is negative and the torque ratio is positive, that is, the range from θ2[°] to 0[°] of the rotation angle of the balance corresponds to the torque ratio acting to advance the timepiece (shown with +).

On the other hand, a range in which the rotation angle of the balance is negative and the torque ratio is negative, that is, the range from θ1[°] to θ2[°] of the rotation angle of the balance corresponds to the torque ratio acting to delay the timepiece (shown with −). In addition, a range in which the rotation angle of the balance is positive and the torque ratio is positive, that is, the range from 0[°] to θ3[°] of the rotation angle of the balance also corresponds to the torque ratio acting to delay the timepiece (shown with −).

Comparing the torque ratio of the escapement 501 according to the present embodiment (see FIG. 13A) with the torque ratio of the escapement according to the comparative example (see FIG. 13B), in the escapement 501 of the present embodiment, the area (hatched portion in the drawing) of the positive torque ratio increases compared to the escapement of the comparative example, and the torque transmission efficiency from the escape wheel 510 to the pallet 550 improves.

Further, in the escapement 501 of the present embodiment, a ratio of the torque ratio (area shown with +) acting to advance the timepiece relative to the torque ratio (area shown with −) acting to delay the timepiece is increased compared to the escapement of the comparative example, and the positive area approaches the negative area and accordingly the error of the escapement 501 is reduced.

Moreover, in the comparative example in which the torque is received at the entry pallet jewel, as shown in FIG. 13B, the torque suddenly fluctuates at the rotation angle θ4[°], resulting in discontinuity of the torque value since the configuration of the contact to the tooth 511 changes (change from the surface contact to the line contact on the corner) while receiving the torque at the impact surface from the tooth 511 of the escape wheel 510. However, in the escapement 501 of the present embodiment in which the configuration of the contact between the convex portion 513 of the escape wheel 510 and the tip portion 557*a* of the arm portion 557 dose not change while receiving torque, the torque received by the pallet 550 is continuous and accordingly it is possible to avoid the sudden fluctuation of the torque value.

Figure 14A:
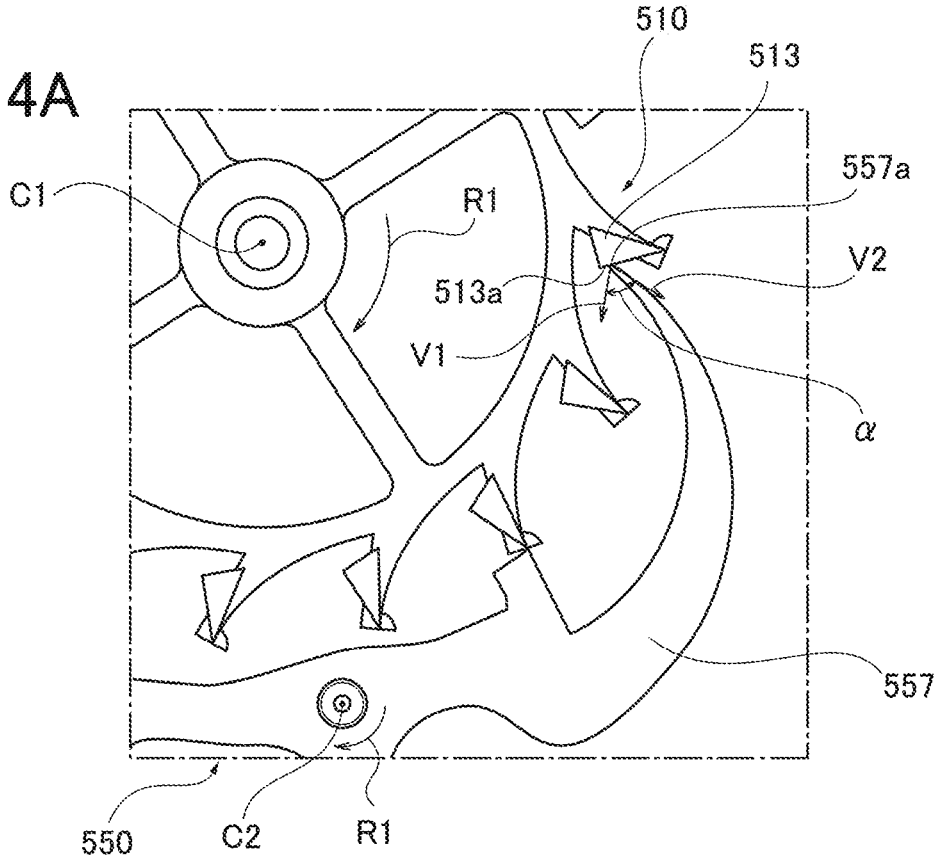
FIG. 14A is a view illustrating the detail of a portion where a tip portion of the arm portion and a front surface of the convex portion relatively move while contacting each other.
Figure 14B:
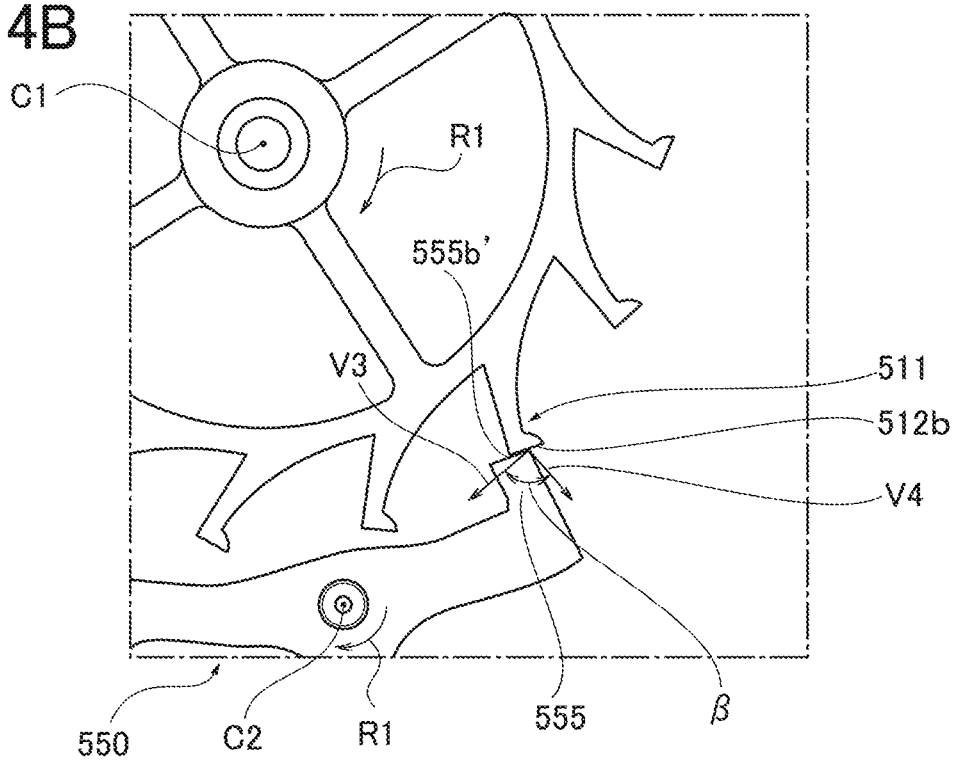
FIG. 14B is a view illustrating the detail of a portion where the impact surface of the entry pallet jewel and an outer surface relatively move while contacting each other in the conventional escapement of the comparative example in which the impact surface receives torque.

FIG. 14A is a view illustrating the details of a portion where the tip portion 557*a* of the arm portion 557 and the front surface 513*a* of the convex portion 513 relatively move while contacting each other. FIG. 14B is a view of the comparative example illustrating the details of a portion where an impact surface 555*b*' of the entry pallet jewel 555 and the outer surface 512*b* relatively move while contacting each other with regard to the conventional escapement in which the impact surface 555*b*' receives the torque.

As shown in FIG. 14A, in the escape wheel 510 of the present embodiment, at the portion where the tip portion 557*a* of the arm portion 557 and the front surface 513*a* of the convex portion 513 relatively move while contacting each other, an angle α at which a moving direction V1 (the tangential direction of the clockwise direction R1) of the escape wheel 510 which rotates in the clockwise direction R1 intersects a moving direction V2 (the tangential direction of the clockwise direction R1) of the pallet 550 which rotates in the clockwise direction R1 is about 60[°]. The arm portion 557 does not have a function to stop the tooth 511 of the escape wheel 510. Therefore, the arm portion 557 does not need to move to reliably stop the rotating escape wheel 510 in a direction substantially perpendicular to the clockwise direction R1 of the escape wheel 510.

On the other hand, as shown in FIG. 14B, in the escapement of the comparative example, at the portion where the impact surface 555*b*' of the entry pallet jewel 555 and the outer surface 512*b* of the tooth 511 relatively move while contacting each other, an angle β at which a moving direction V3 (the tangential direction of the clockwise direction R1) of the escape wheel 510 in the clockwise direction R1 intersects a moving direction V4 (the tangential direction of the clockwise direction R1) of the pallet 550 in the clockwise direction R1 is about 90[°].

That is, the angle α at which the moving direction V1 of the escape wheel 510 intersects the moving direction V2 of the pallet 550 at the portion where the tip portion 557*a* of the arm portion 557 and the front surface 513*a* of the convex portion 513 contact each other is smaller than the angle β at which the moving direction V3 of the escape wheel 510 intersects the moving direction V4 of the pallet 550 at the portion where the impact surface 555*b*' of the entry pallet jewel 555 and the outer surface 512*b* of the tooth 511 in the comparative example contact each other.

Generally, when two contacting members move relative to each other, the influence of the frictional force on torque transmitted at contact portions decreases as an intersecting angle decreases. In addition, the frictional force depends on the states of surfaces of the contacting parts (friction coefficient), and the surface condition generally deteriorates with age, so the friction coefficient tends to increase with age.

That is, when the frictional force increases due to a change in the condition of the surfaces with age, the escapement 501 of the present embodiment in which the angle α is smaller than the angle β of the comparative example can be hardly affected by the increase of the frictional force and reduce the degree of reduction in the torque transmission efficiency compare to the comparative example.

In the escapement 501 of the present embodiment, the angle α is about 60[°]. However, in the escapement of the present invention, the angle α is not limited to about 60[°] but may be, for example, less than 60[°] or more than 60[°] as long as the angle α is smaller than an angle at which the rotation direction of the escape wheel and the rotation (oscillation) direction of the pallet intersect at a portion where the outer surface of the tooth of the escape wheel contacts the impact surface of the entry pallet jewel in the conventional escapement to which the present invention is not applied.

In addition, according to the escape wheel 510 of the present embodiment, it is possible to prevent the convex portions 513 from contacting the entry pallet jewel 555 and/or the exit pallet jewel 556 since the convex portions 513 on the escape wheel 510 are formed to protrude in the direction of the shaft center C1 from the end surface 514 of the escape wheel 510.

Further, it is also possible to avoid excessive restrictions on the shape and the arrangement of the convex portions 513 for preventing contact with the entry pallet jewel 555 and/or the exit pallet jewel 556 since the convex portions 513 are formed to protrude from the end surface 514 of the escape wheel 510.

Moreover, in the escape wheel 510 of the present embodiment, the entry pallet jewel 555 contacts the escape wheel 510 only at the stop surface 555*a* but does not contact the escape wheel 510 at the outer surface 555*b* facing outward. In other words, the entry pallet jewel 555 contacts the escape wheel 510 only at a surface (stop surface 555*a*) which stops the escape wheel 510. Therefore, the entry pallet jewel 555 only performs the function of switching the stop of the rotation of the escape wheel 510 and the release of the stop (rotation) of the rotation thereof.

On the other hand, the arm portion 557 does not need to have the function of switching the stop of the rotation of the escape wheel 510 and the release of the stop (rotation) of the rotation thereof, but only performs the function of receiving the torque from the escape wheel 510. Thereby, in the escapement 501 of the present embodiment, it is possible to separate functions between the entry pallet jewel 555 and the arm portion 557, and accordingly to optimize the shapes of the entry pallet jewel 555 and the arm portion 557.

(Variations)

In the escape wheel 510 of the embodiment, the pallet 550 is integrally formed and made of silicon, but may be made of other materials such as metal. In the escapement of the present invention, the entry pallet jewel 555, the exit pallet jewel 556, the arm portion 557 and the like may be made of stone or the like different from the material of the lever 551 and the arm 552 which are parts of the body of the pallet 550.

The convex portion 513 of the escapement 501 according to the present embodiment is formed in the triangular prism shape. However, the convex portion of the escapement according to the present invention is not limited to the triangular prism shape but may be formed in a quadrangular prism shape or the like. Further, the convex portion 513 may not be a mass member such as in a prismatic shape. That is, the convex portion only has a surface (front surface 513*a*) which applies torque to the arm portion 557 by contacting the tip portion 557*a* of the arm portion 557, and may be a thin plate having a surface which applies such torque if there is no restriction in terms of strength.

In the escape wheel 510 of the present embodiment, the arm portion 557 is formed to be curved in the arc shape, but the arm portion 557 may be formed to be linear.

Figure 15A:
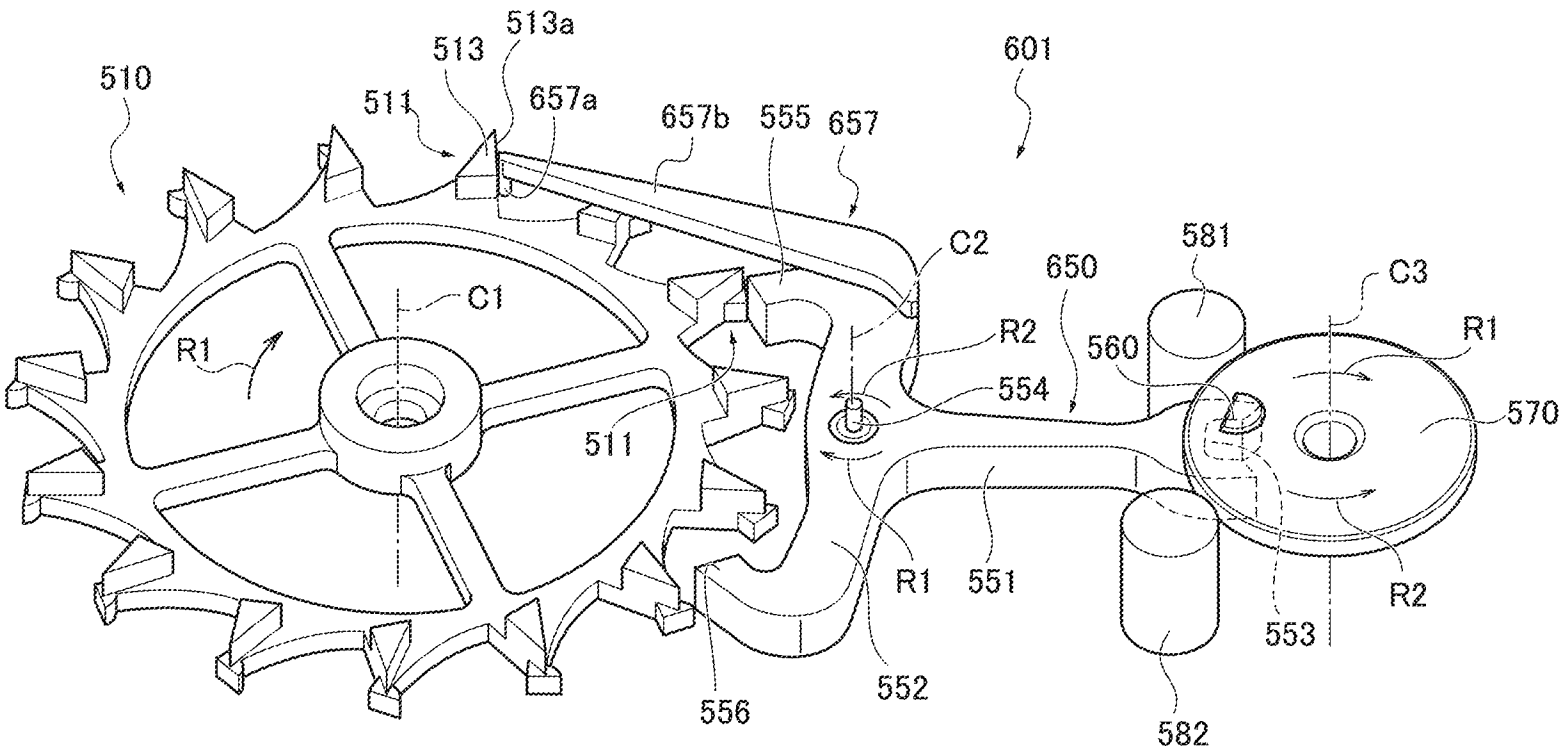
FIG. 15A is a perspective view corresponding to FIG. 11 and illustrating an escapement as a variation, which includes an arm portion in a linear shape replaced from the arm portion of the escapement according to the embodiment shown in FIG. 11.

FIG. 15A is a perspective view corresponding to FIG. 11 and illustrating an escapement 601 as a variation. The escapement 601 includes an arm portion 657 formed in a linear shape and replaced from the arm portion 557 in the escapement 501 of the embodiment shown in FIG. 11. The escapement 601 is also one of embodiments of the escapement according to the present invention.

In the escapement 501 shown in FIG. 11, the arm portion 557 is formed at the same height position (position along the direction of the shaft center C1) as the convex portions 513. On the other hand, in the escapement 601 shown in FIG. 15A, a pallet body of a pallet 650 includes the lever 551, the arm 552, the entry pallet jewel 555, and the exit pallet jewel 556, and an arm portion 657 protrudes in a height direction (direction of the shaft center C1) higher than the pallet body. A body portion 657*b* of the arm portion 657 is disposed at a position higher than a position of the convex portions 513 of the escape wheel 510 so that the body portion 657*b* does not contact the convex portions 513.

The body portion 657*b* includes a protruding portion 657*a* which protrudes downward in the height direction. For example, the protruding portion 657*a* is formed in a cylindrical shape. The outer surface of the protruding portion 657*a* contacts the front surface 513*a* of the convex portion 513 of the escape wheel 510 to receive torque from the escape wheel 510 from when the entry pallet jewel 555 disengages from the tooth 511 until the exit pallet jewel 556 contacts the tooth 511 as the tip portion 557*a* of the arm portion 557 in the escapement 501.

Thereby, the escapement 601 can achieve an operation and an effect similar to those of the escapement 501 shown in FIG. 11.

In addition, the shape of the body portion 657*b* which does not contact the convex portions 513 and the teeth 511 can be more easily selected and the degree of freedom of design can be increased compared to the arm portion 557 of the escapement 501 shown in FIG. 11 since the body portion 657*b* of the arm portion 657 is disposed at the position higher than the position of the convex portions 513.

Figure 15B:
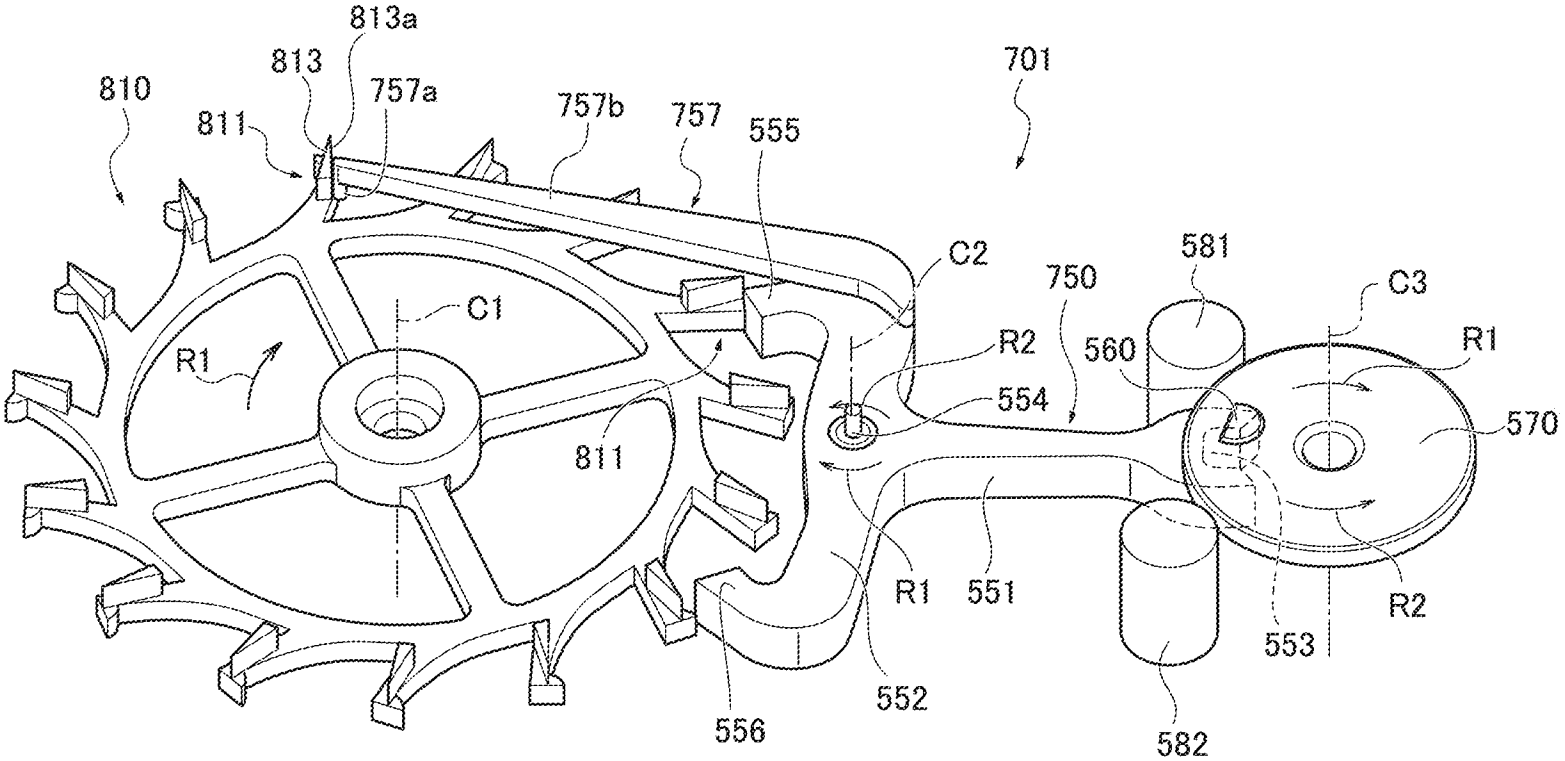
FIG. 15B is a perspective view corresponding to FIG. 15A and illustrating an escapement as a variation, which includes a longer arm portion replaced from the arm portion in the escapement of the variation shown in FIG. 15A, convex portions replaced from the convex portions and each having a different shape since the convex portions the arm portion contact are replaced, and teeth replaced from the teeth and each having a different shape.

FIG. 15B is a perspective view corresponding to FIG. 15A and illustrating an escapement 701 as a variation. The escapement 701 includes an arm portion 757 which is replaced from the arm portion 657 in the escapement 601 of the variation shown in FIG. 15A. The arm portion 757 is longer than the arm portion 657 and includes a protruding portion 757*a*. The escapement 701 includes convex portions 813 and teeth 811 replaced from the convex portions 513 and the teeth 511, respectively since the convex portions 813 each contacting the outer surface of the protruding portion 757*a* are replaced with the convex portions 513. Each of the convex portions 813 has a shape different from that of the convex portion 513 and each of the teeth 811 has a shape different from that of the tooth 511. The escapement 701 is also one of the embodiments of the escapement according to the present invention.

In the escapement 601 shown in FIG. 15A, the protruding portion 657*a* of the arm portion 657 contacts the front surface 513*a* of the convex portion 513 provided on the second tooth 511 behind the tooth 511 in the clockwise direction R1 which the entry pallet jewel 555 contacted so that the pallet 650 receives the torque. However, in the escapement 701 shown in FIG. 15B, the protruding portion 757*a* of the arm portion 757 contacts a front surface 813*a* of the convex portion 813 provided on a third tooth 811 behind the tooth 811 in the clockwise direction R1 which the entry pallet jewel 555 contacted so that the pallet 750 receives the torque.

The escapement 701 as configured above can also achieve an operation and an effect similar to those of the escapement 601 shown in FIG. 15A. Note that the shape of the convex portion 813 in the escapement 701 differs from that of the convex portion 513 in the escapement 601 since the position of the convex portion the protruding portion 757*a* of the arm portion 757 of the pallet 750 contacts is different. Note that the shape of the tooth 811 of the escape wheel 810 in the escapement 701 differs from that of the tooth 511 of the escape wheel 510 in the escapement 601 since the shape of the convex portion 813 differs from that of the convex portion 513.

Each of the convex portions 513, 813 in the embodiments and the variations is formed on the tooth 511, 811, respectively. However, the convex portion 513, 813 may be formed between two teeth 511, 511 or 811, 811, respectively. Further, the convex portion 513, 813 may not be integrally formed on each of the teeth 511, 811, respectively.

The convex portion 513, 813 are not limited to the triangular prism shape described in the embodiments and the variations, but the shape of the convex portion may be appropriately selected from other shapes. That is, the convex portion 513, 813 only have the front surface 513*a*, 813*a* which respectively contacts the tip portion 557*a* of the arm portion 557, 657, 757 or the protruding portion 657*a*, 757*a*, and may be a thin plate having the front surface 513*a*, 813*a* as long as the convex portion has sufficient strength against the contact.

Figure 16:
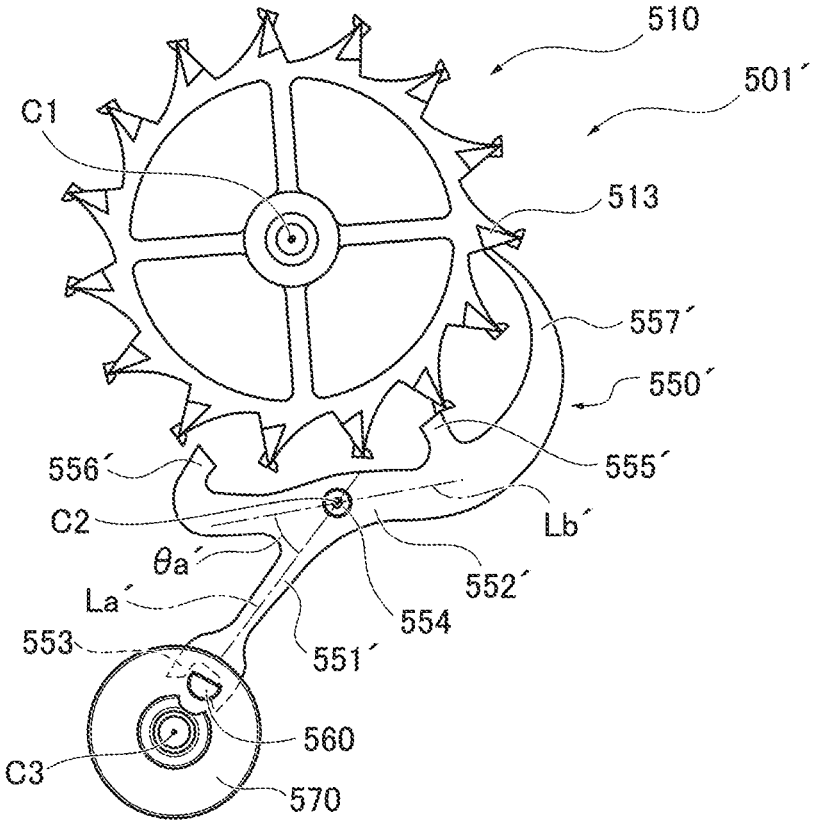
FIG. 16 is a view corresponding to FIG. 12A and illustrating an escapement which is a variation of the escapement shown in FIG. 11, which includes another pallet replaced from the pallet of the escapement.

FIG. 16 is a view corresponding to FIG. 12A and illustrating an escapement 501' which is a variation of the escapement 501 shown in FIG. 11. The escapement 501' includes a pallet 550' replaced from the pallet 550 of the escapement 501. As shown in FIG. 12A, the pallet 550 has a shape in which the arm 552 crosses the lever 551 substantially perpendicular thereto. Specifically, an angle $\theta\alpha$ at which a center line La of the lever 551 intersects a center line Lb of the arm 552 is about 90[°].

On the other hand, as shown in FIG. 16, the pallet 550' of the escapement 501' has a shape in which an arm 552' crosses a lever 551' at an angle smaller than 90[°]. Specifically, an angle $\theta\alpha'$ at which a center line La' of the lever 551' crosses a center line Lb' of the arm 552' is 45[°] which is a half of 90[°], or about 45[°]. In addition, the pallet 550' has a shape in which the arm 552' is inclined at the side of an exit pallet jewel 556' toward the lever 551'. That is, the pallet 550' has a shape in which an arm portion 557' of the arm 552' formed on a side opposite to the exit pallet jewel 556' is inclined away from the lever 551'.

The arm 552 of the pallet 550 includes the arm portion 557 having a long dimension on the outside of the entry pallet jewel 555. Accordingly, the weight balance is biased toward the side of the entry pallet jewel 555 with respect to the shaft center C2 of the pallet pivot 554 which is the rotation center of the pallet 550. Accordingly, the position of the center of gravity of the pallet 550 as a whole also shifts from the shaft center C2 of the pallet pivot 554 to the side of the entry pallet jewel 555.

Also in the pallet 550', the center of gravity of the arm 552' is biased toward the side of the entry pallet jewel 555'. However, with regard to the pallet 550' as a whole, the center of gravity of the arm 552' biased toward the side of the entry pallet jewel 555' is located to be cancelled by the weight of the lever 551' formed on the opposite side across the shaft center C2 of the pallet pivot 554. Accordingly, the center of gravity of the entire pallet 550' can be brought closer to the shaft center C2 of the pallet pivot 554. Accordingly, the escapement 501' can suppress the damping of the oscillation (vibration) of the pallet 550' about the shaft center C2 compared to the escapement 501.

In the escapement 1 of the first embodiment described above, the escape wheel 10 includes the convex portions 13 as an example of the torque applying member and the pallet 50 includes the third pallet jewel 58 as an example of the torque receiving member. In the escapement 501 of the second embodiment, the escape wheel 510 includes the convex portions 513 as an example of the torque applying member and the pallet 550 includes the arm portion 557 as an example of the torque receiving member. However, the escapement for the timepiece according to the present invention may be configured by combining the escapement 1 and the escapement 501.

Specifically, the pallet includes the third pallet jewel as the first torque receiving member between the entry pallet jewel and the exit pallet jewel, and the arm portion as the second torque receiving member on the outside of the entry pallet jewel. The escape wheel includes the first convex portion as the first torque applying member that applies torque to the third pallet jewel on one side of a surface, and the second convex portion as the second torque applying member that applies torque to the arm portion on the other side of the surface. The escapement including the pallet and the escape wheel is configured by combining the escapement 1 and the escapement 501, and one of the examples of the escapement for the timepiece according to the present invention.

The invention claimed is:

1. An escapement for a timepiece comprising:

an escape wheel that is configured to rotate about a shaft center and comprises a plurality of teeth and a torque applying member that applies torque; and a pallet that oscillates, and comprises an entry pallet jewel and an exit pallet jewel, wherein the entry pallet jewel switches a rotation of the escape wheel and a stop of the escape wheel and receives torque from the escape wheel by contacting a tooth of the teeth, and the exit pallet jewel at least switches the rotation of the escape wheel and the stop of the escape wheel, wherein the escape wheel and a balance apply and receive torque only via the pallet, wherein in addition to the entry pallet jewel and the exit pallet jewel, the pallet comprises a torque receiving member that receives torque from the torque applying member by contacting the torque applying member, and wherein a thickness of the torque receiving member in a direction parallel to an axis of rotation of the pallet is less than a thickness of the entry pallet jewel and a thickness of the exit pallet jewel.

2. The escapement according to claim 1, wherein the entry pallet jewel receives torque from the escape wheel by contacting the tooth.

3. The escapement according to claim 1, wherein the exit pallet jewel comprises an impact surface that is inclined to face an outside of the pallet, a stop surface that stops the escape wheel, and a locking corner that connects the impact surface and the stop surface, wherein torque is applied from an other tooth of the teeth of the escape wheel to the exit pallet jewel by a surface of the other tooth contacting the locking corner.

4. The escapement according to claim 1, wherein the torque applying member is formed on a portion that has a shorter radius from the shaft center than a surface of the tooth that applies torque to the exit pallet jewel.

5. The escapement according claim 1, wherein the torque applying member and the torque receiving member are arranged to contact each other before a contact of a surface of the tooth and the exit pallet jewel is terminated.

6. The escapement according to claim 1, wherein the torque receiving member is at a portion of the pallet having a distance from a center of the oscillation of the pallet that is longer than a distance from the center of the oscillation of the pallet to the entry pallet jewel, and wherein the torque receiving member receives torque by contacting the torque applying member during a period from when the entry pallet jewel disengages from the tooth until the exit pallet jewel contacts the tooth.

7. The escapement according to claim 6, wherein the torque receiving member is an arm portion, and the arm portion is formed on an outside of the entry pallet jewel when viewed from a shaft center of a pallet pivot.

8. The escapement according to claim 1, wherein the torque receiving member is disposed at a position that receives torque for rotating the pallet in a same direction as a rotation direction of the pallet when the entry pallet jewel disengages from the tooth of the escape wheel.

9. The escapement according to claim 1, wherein the torque applying member and the torque receiving member contact at a position where an angle at which a rotation direction of the escape wheel intersects an oscillating direction of the pallet at a portion where the torque applying member and the torque receiving member contact each other becomes smaller than an angle at which a rotation direction of the escape wheel intersects an oscillating direction of the pallet at a portion where the tooth and the entry pallet jewel contact each other.

10. The escapement according to claim 1, wherein the entry pallet jewel contacts the escape wheel only at a surface that stops the escape wheel.

11. The escapement according to claim 1, wherein the torque applying member is a convex portion formed to protrude from an end surface of the escape wheel that is perpendicular to the shaft center.

12. The escapement according to claim 1, wherein a width dimension of the torque receiving member in a direction perpendicular to the axis of rotation of the pallet is smaller than a width dimension of the entry pallet jewel and a width dimension of the exit pallet jewel.

* * * * *